US012179056B2

(12) United States Patent
Wuttke et al.

(10) Patent No.: US 12,179,056 B2
(45) Date of Patent: Dec. 31, 2024

(54) EXERCISE APPARATUS

(71) Applicant: Heba Pilates Ltd., Windsor (GB)

(72) Inventors: Moritz Wuttke, Windsor (GB); Samantha Kellard, Windsor (GB)

(73) Assignee: Heba Pilates Ltd., Windsor (GB)

( * ) Notice: Subject to any disclaimer, the term of this patent is extended or adjusted under 35 U.S.C. 154(b) by 208 days.

(21) Appl. No.: 17/706,166

(22) Filed: Mar. 28, 2022

(65) Prior Publication Data

US 2022/0314055 A1 Oct. 6, 2022

(30) Foreign Application Priority Data

Mar. 31, 2021 (GB) ..... 2104646

(51) Int. Cl.

*A63B 21/04* (2006.01)
*A63B 21/00* (2006.01)
*A63B 21/02* (2006.01)

(52) U.S. Cl.

CPC ..... *A63B 21/0428* (2013.01); *A63B 21/023* (2013.01); *A63B 21/154* (2013.01); *A63B 21/4035* (2015.10); *A63B 2210/50* (2013.01)

(58) Field of Classification Search

CPC . A63B 21/0428; A63B 21/023; A63B 21/154; A63B 21/4035; A63B 2210/50; A63B 22/0087; A63B 2225/09; A63B 2225/102; A63B 21/4033; A63B 21/4045; A63B 22/203; A63B 69/0057; A63B 21/0557; A63B 21/055; A63B 21/0552; A63B 21/068; A63B 22/0089; A63B 23/03566; A63B 21/0442

See application file for complete search history.

(56) References Cited

U.S. PATENT DOCUMENTS 4,721,303 A 1/1988 Fitzpatrick
7,537,554 B2 * 5/2009 Zhuang ..... A63B 21/04 482/121

(Continued)

FOREIGN PATENT DOCUMENTS

ES 2396852 A1 2/2013

OTHER PUBLICATIONS

European Search Report dated Aug. 26, 2022 in corresponding European Application No. 22165707.5.

(Continued)

*Primary Examiner* — Andrew S Lo

(74) *Attorney, Agent, or Firm* — Harness, Dickey & Pierce, P.L.C.

(57) ABSTRACT

An exercise apparatus for assisting a user with a range of exercises includes a frame having a first frame section extending in a generally horizontal direction. At least one carriage is configured to support a user, wherein the carriage is slidably supported on the first frame section. A first resistance system has a first resilient member removably connected to at least one of the carriage and/or the frame. The displacement of the carriage relative to the frame exerts a tensile force on the resilient member. A second resistance system includes a load moveably mounted with respect to the frame and an actuation member connected to the load. The actuation member is configured to displace the load when a force exerted by the user on the actuating member exceeds a predetermined threshold representative of the load.

25 Claims, 13 Drawing Sheets

(56) References Cited

U.S. PATENT DOCUMENTS 7,803,095 B1 * 9/2010 LaGree ..... A63B 22/0089 482/121
7,833,139 B1 * 11/2010 Endelman ..... A63B 21/4045 482/123
D726,263 S * 4/2015 Anderson ..... D21/676
9,011,296 B2 * 4/2015 Peralo ..... A63B 23/03575 482/123
10,556,146 B2 * 2/2020 Latronica ..... A63B 21/4035
11,147,999 B1 * 10/2021 Lagree ..... A63B 21/04
11,395,936 B1 * 7/2022 Lagree ..... A63B 22/0046
11,420,087 B2 * 8/2022 Aronson ..... A63B 21/00072
11,439,887 B2 * 9/2022 Lagree ..... A63B 22/0089
11,839,786 B2 * 12/2023 Lagree ..... A63B 21/023
2004/0248713 A1 * 12/2004 Campanaro ..... A63B 21/068 482/123
2008/0318740 A1 * 12/2008 Ross ..... A63B 21/063 482/92
2009/0023561 A1 * 1/2009 Ross ..... A63B 21/055 482/92
2009/0118108 A1 * 5/2009 Uygan ..... A63B 22/0087 482/135
2009/0143201 A1 * 6/2009 Uygan ..... A63B 21/4035 482/121
2010/0323857 A1 * 12/2010 D'Silva ..... A63B 22/001 482/121
2012/0108401 A1 * 5/2012 Uygan ..... A63B 23/03541 482/94
2012/0283079 A1 * 11/2012 Solow ..... A63B 21/00065 482/142
2013/0210593 A1 * 8/2013 Mcbride ..... A63B 23/1218 482/142
2014/0100089 A1 * 4/2014 Kermath ..... A63B 21/0428 482/133
2014/0121076 A1 * 5/2014 Lagree ..... A63B 21/023 482/123
2014/0141948 A1 5/2014 Aronson et al.
2014/0309087 A1 * 10/2014 Uygan ..... A63B 21/156 482/93
2018/0169464 A1 * 6/2018 Janowski ..... A63B 21/068
2019/0358484 A1 11/2019 Lagree et al.
2020/0188720 A1 * 6/2020 Villency ..... A63B 21/4031
2021/0128975 A1 * 5/2021 Elliott ..... A63B 21/028
2022/0176194 A1 * 6/2022 Barragan ..... A63B 21/4045
2022/0266087 A1 * 8/2022 Amoros ..... A63B 21/0428

OTHER PUBLICATIONS

United Kingdom Search Report dated Sep. 2, 2021 in corresponding Great Britain Application No. GB2104646.1.

* cited by examiner

EXERCISE APPARATUS

CROSS-REFERENCE TO RELATED APPLICATION

This application claims the benefit and priority of Great Britain Application No. 2104646.1, filed Mar. 31, 2021. The entire disclosure of the above application is incorporated herein by reference.

FIELD

The present teachings relate to an exercise apparatus for assisting a user with a range of exercises.

BACKGROUND

Exercise apparatuses are used in a variety of forms of exercise both at home and in a gym, fitness studio or public workout space. An example of such an exercise apparatus is a Pilates reformer, commonly used for Pilates training. Typically, Pilates training involves the use of variable resistance, using springs or the like, which has been found to be beneficial when used incorporated into Pilates exercises.

Springs are typically connected between a carriage and the end of a frame of the exercise apparatus to provide the required variable resistance. Typically, the entire spring is connected to/removed from the exercise apparatus, which is a complex and time consuming process for the user. This is a particular problem when the exercise apparatus is being used in a live or virtual class, and the user wastes times connecting/removing the springs. Additionally, there is a safety concern associated with the connecting/removal of the springs as the user can trap a body part.

In addition, these types of exercise apparatus take up a relatively large amount of space in the public workout space or home. Since the exercise apparatus only allows for variable resistance training or bodyweight training, there are limits in terms of the range of exercises the user can perform, and the range of strength and fitness goals the user can readily achieve. Therefore, it is likely the user will have to use separate equipment if they have fitness goals outside the limits of the exercise apparatus known in the art.

Due to the size and expense of common exercise apparatuses, there are significant disadvantages in having to buy an entirely separate exercise apparatus to perform a wider range of exercises. This is especially problematic in a class where the instructor wants to combine variable resistance training with constant resistance training.

The present teachings seek to overcome or at least mitigate one or more problems associated with the prior art.

SUMMARY

A first aspect of the teachings provides an exercise apparatus for assisting a user with a range of exercises, the exercise apparatus comprising:

- a frame comprising a first frame section extending in a generally horizontal direction;
- at least one carriage configured to support a user, wherein the carriage is slidably supported on the first frame section;
- a first resistance system comprising:
- a first resilient member removably connected to at least one of the carriage or the frame or both;
- wherein displacement of the carriage relative to the frame exerts a tensile force on the resilient member; and

- a second resistance system comprising:
- a load moveably mounted with respect to the frame; and
- an actuation member connected to the load;
- wherein the actuation member is configured to displace the load when a force exerted by the user on the actuating member exceeds a predetermined threshold representative of the load.

Advantageously, the exercise apparatus includes two different resistance systems. The first resistance system can be used for variable resistance training. The first resistance system includes the resilient member, meaning that as the displacement of the carriage relative to the frame increases, the tensile force exerted on the resilient member increases. The second resistance system can be used for constant resistance training. The second resistance system includes a load, and the force required to displace the load is constant throughout the movement range of the actuation member by the user.

The two types of resistance systems, variable and constant, have been found to have different advantages depending on the movement performed and the overall fitness goal of the user. Variable resistance training has the benefits of increasing the resistance when the muscles are at their strongest point in the movement. This can have increased strength benefits because the user is not limited by the maximum strength at the weakest point in the movement. Additionally, the risk of injury has been found to be lower for variable resistance training. Constant resistance training has the benefits of being more functional, meaning the movements used in specific sports are better replicated by constant resistance training. Additionally, constant resistance training has been found to stimulate more muscles at one time, because muscles are used to stabilise the working muscle.

Additionally, the user can perform exercises using a combination of constant and variable resistance concurrently or successively on the same apparatus. Therefore, it is advantageous to provide an exercise apparatus which allows for both variable resistance training and constant resistance training in an apparatus that is compact and self-contained, minimising the space required in fitness studios, gyms and the like.

The frame may comprise a second frame section extending in a substantially vertical direction from a first end of the frame.

Advantageously, the vertical section provides a surface for the user to engage with when performing exercises. Additionally, the vertical section is space efficient as it takes up minimal floor space.

The first frame section may be pivotable relative to the second frame section between the generally horizontal position and a generally vertical position.

Advantageously, the folding of the first frame section creates additional floor space, meaning the user can perform a greater range of exercises without being obstructed by the first frame section. This is particularly advantageous when the user is performing exercises using the second resistance system.

The frame may include a securing mechanism for securing the first frame section to the second frame section when the first frame section is in the generally vertical position.

Advantageously, the provision of a securing mechanism help to retain the frame in the vertical position, and may inhibit the first frame section from being released from the vertical position and injuring the user.

The first resilient member may be located on the second frame section, optionally in a generally vertical orientation, optionally the first resilient member may be spaced apart from the first end of the first frame section.

Advantageously, since the user is supported on the carriage which is slidably supported on the first frame section, the first resilient member is out of the way of the user when located on the second frame section. This increases the safety of the exercise apparatus because the likelihood of the user trapping or catching a body part on the resilient member is reduced. Additionally, this reduces the level of noise experienced by the user because the first resilient member is further away from the user.

The first resilient member may be removably connectable to the carriage via a connecting member, optionally the connecting member may be a cable, cord, rope or the like.

Advantageously, this means the user engages with the connecting member instead of the resilient member, increasing the safety of the exercise apparatus and accessibility of the resilient member via the connecting member. Additionally, the connecting member being removable means that the transfer of the tensile force from the carriage to the first resilient member is removable, which increases the versatility of the exercise apparatus.

The connecting member may be connectable to the carriage via a first attachment device, for example a loop.

Advantageously, this connects the resilient member to the carriage via the connecting member and facilitates the transfer of the tensile force, without the user having to directly engage with the first resilient member.

The carriage may include a first attachment location for connecting to the first attachment device, optionally the first attachment location may be positioned at least partially beyond an upper edge of an upper surface of the carriage.

Advantageously, the provision of an attachment location is a simple way for the user to connect the connecting member to the carriage. The attachment location being located beyond an upper edge of an upper surface of the carriage improves the visibility of the attachment location and helps to prevent the attachment location from obstructing the user when they perform an exercise.

The first resistance system may include a second resilient member, and the second resilient member may be removably connected between the carriage and a second end of the frame.

Advantageously, this provides a second tensile force in an opposing direction to the first tensile force, which increases the range of exercises the user can perform. Additionally, the provision of a second resilient member increases the number of possible resistance levels selectable by the user.

The second resilient member may include a second attachment device for removably connecting the second resilient member to the carriage, for example a loop.

Advantageously, this connects the second resilient member the carriage and facilitates the transfer of the tensile force. Additionally, the second connecting member being removable means that the transfer of the tensile force from the carriage to the second resilient member is removable, which increases the versatility of the exercise apparatus.

The frame may include a second attachment location for connecting the second attachment device.

Advantageously, the provision of the second attachment location is a simple way for the user to connect the second resilient member to the frame.

The exercise apparatus may comprise a second carriage, optionally the first carriage and second carriage may be slidable relative to each other.

Advantageously, this increases the versatility of the exercise apparatus because the user can perform a greater range of exercises.

The first resistance system may include a third resilient member, and a first end of the third resilient member may be removably connected to the first carriage, and a second end of the third resilient member may be removably connected to the second carriage.

Advantageously, this provides a third tensile force between the first carriage and second carriage, which increases the range of exercises the user can perform. Additionally, the provision of a third resilient member increases the number of possible resistance levels selectable by the user.

The third resilient member may include a third attachment device for removeably connecting the first and second carriages, for example a loop.

Advantageously, this connects the third resilient member to the first and second carriages and facilitates the transfer of the tensile force. Additionally, the third connecting member being removeable means that the transfer of the tensile force from the first and second carriages to the third resilient member is removeable, which increases the versatility of the exercise apparatus.

The first or second carriage may include a third attachment location for connecting to the third attachment device, optionally the third attachment location may be positioned at least partially beyond an upper edge of an upper surface of the first or second carriage.

Advantageously, the provision of a third attachment location is a simple way for the user to connect the resilient member to the carriage. The third attachment location being located at least partially beyond an upper edge of an upper surface of the first or second carriage improves the visibility of the attachment location and helps to prevent the attachment location from obstructing the user when they perform an exercise.

At least one of the second and/or third resilient members may be supported on an underside of the first and/or the second carriage.

Advantageously, this minimises user contact with the resilient members and therefore increases safety of the exercise apparatus. Additionally, the likelihood of the resilient members obstructing the user when they perform an exercise is reduced, and supports the springs in the correct position when the first frame section is in the vertical position.

The underside of the first carriage may include at least one channel for housing the second resilient member, optionally the underside of the second carriage may include at least one channel for housing the third resilient member.

Advantageously, the channel retains the resilient members on the underside of the carriage, and reduces the level of noise as the resilient members extend and contract.

The first resilient member may be a first set of resilient members and each of the first set of resilient members may be removably connected to the frame and/or the carriage, optionally the second resilient member may be a second set of resilient members and each of the second set of resilient members may be removably connected to the frame and/or carriage, and optionally the third resilient member may be a third set of resilient members and each of the third set of resilient members may be removably connected to the first carriage and/or second carriage.

Advantageously, any combination of resilient members from the first, second and third sets can be connected to the frame and/or the carriages. This increases the range of resistance levels available to the user, and therefore makes the exercise apparatus suitable for a range of abilities and a range of fitness goals, for example recovering from injury or strength gains.

At least one of first, second and/or third resilient members may be springs.

Advantageously, springs can provide the required range of stiffness suitable for the tensile force requirements of the resilient members. Additionally, springs are simple to manufacture and are durable.

The second resistance system may include a support connected to the frame, and the support may be configured to support the load, optionally the support may be connected to the first actuation member.

The second resistance system may include a first pulley system connected to the actuation member, optionally the second resistance system may include a second pulley system connected to the actuation member.

Advantageously, the first and/or second pulley system is a simple way of facilitating the transfer of the force exerted by the user on the actuation member to displace the load.

The exercise apparatus may comprise at least one fixed carriage removably assembled on the frame, optionally the fixed carriage may restrict the movement of the first carriage.

Advantageously, this increases the size of the carriage, and provides a stationary base on which the user can perform a greater range of exercises.

The frame may include a handle beam located at the first end of the frame, optionally the handle beam may be pivotable relative to the frame.

Advantageously, the provision of the handle beam assists the user in performing a greater range of exercises on the exercise apparatus. The handle beam being pivotable means the handle beam can be moved out of the way of the user when they perform an exercise, and when the exercise apparatus is in the vertical position.

The frame may include a leg located at the second end of the frame, optionally a section of the leg may extend in a direction perpendicular to a longitudinal axis of the first frame section.

Advantageously, the leg supports the frame and can be used to perform additional exercises when the frame is in the vertical position.

The second resistance system may comprise a plurality of weighted members, for example weighted plates, and at least one of the weighted members may be mounted to the frame to provide the load.

Advantageously, this means the user can selectively mount the plates to the frame in order to provide a range of different loads. This increases the versatility of the exercise apparatus as it can be used by a range of different abilities.

A further aspect of the teachings provides an exercise apparatus for assisting a user with a range of exercises, the exercise apparatus comprising:

- a frame comprising a first frame section extending in a generally horizontal direction;
- at least one carriage configured to support a user, wherein the carriage is slidably supported on the first frame section;
- a first resistance system comprising:
- a first resilient member removably connected to at least one of the carriage and/or the frame;
- wherein displacement of the carriage relative to the frame exerts a tensile force on the resilient member; and
- wherein the first resilient member extends in a generally vertical direction.

DRAWINGS

Embodiments will now be described with reference to the accompanying drawings, in which.

DETAILED DESCRIPTION

Figure 1:
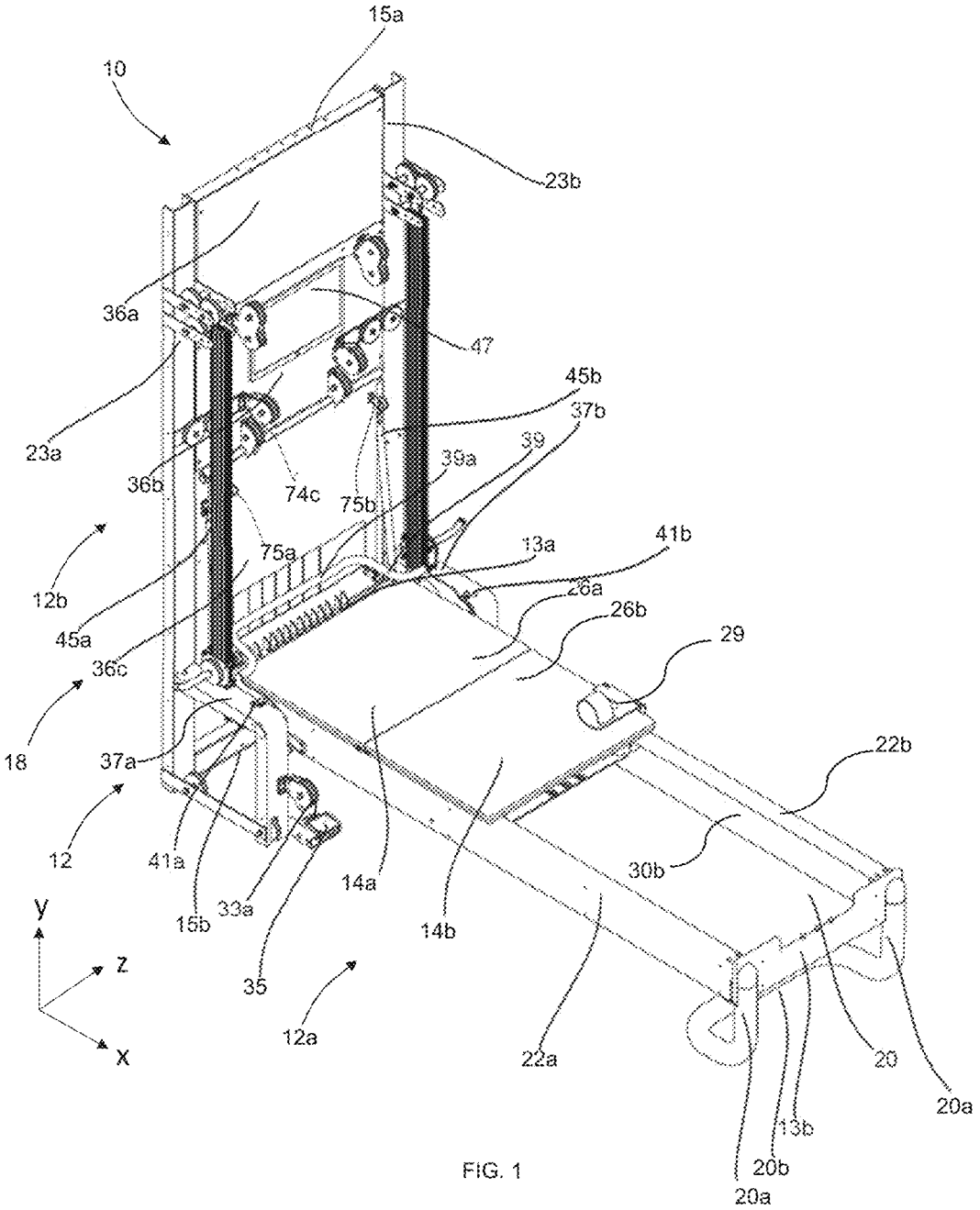
FIG. 1 is an isometric view of an exercise apparatus of the present teachings having a first resistance system and a second resistance system.

FIG. 1 shows an exercise apparatus of an embodiment of the present teachings generally indicated at 10. Typically, the exercise apparatus 10 is used to perform Pilates exercises, however the exercise apparatus 10 may be used to perform a variety of further exercises—e.g. for other disciplines similar to Pilates or for more general strength and core stability based exercises. The exercise apparatus 10 is suitable for use in a gym, a fitness studio, a public space or in a user's home.

The exercise apparatus 10 includes a frame 12, at least one carriage 14*a-d*, a first resistance system 16 and a second resistance system 18. In this embodiment, the frame 12 includes a first frame section 12*a* and a second frame section 12*b*, however in alternative embodiments any suitable number of frame sections may be provided.

It shall be appreciated that the term 'horizontal' refers to a direction parallel to the floor, also referred to as the x-axis, and the term 'vertical' refers to a direction perpendicular to the floor, also referred to as the y-axis. The z-axis is an axis perpendicular to the x-axis and the y-axis, as illustrated in FIG. 1.

As depicted in FIG. 1, the first frame section 12*a* extends in the generally horizontal direction and has a first end 13*a* and a second end 13*b*. The second frame section 12*b* extends in a generally vertical direction from the first end 13*a* of the first frame section 12*a* and has a first end 15*a* and a second end 15*b*.

The frame 12 is at least partially manufactured from a metallic material, in this embodiment steel, however in alternative embodiments any suitable material may be used, for example wood.

Figure 2:
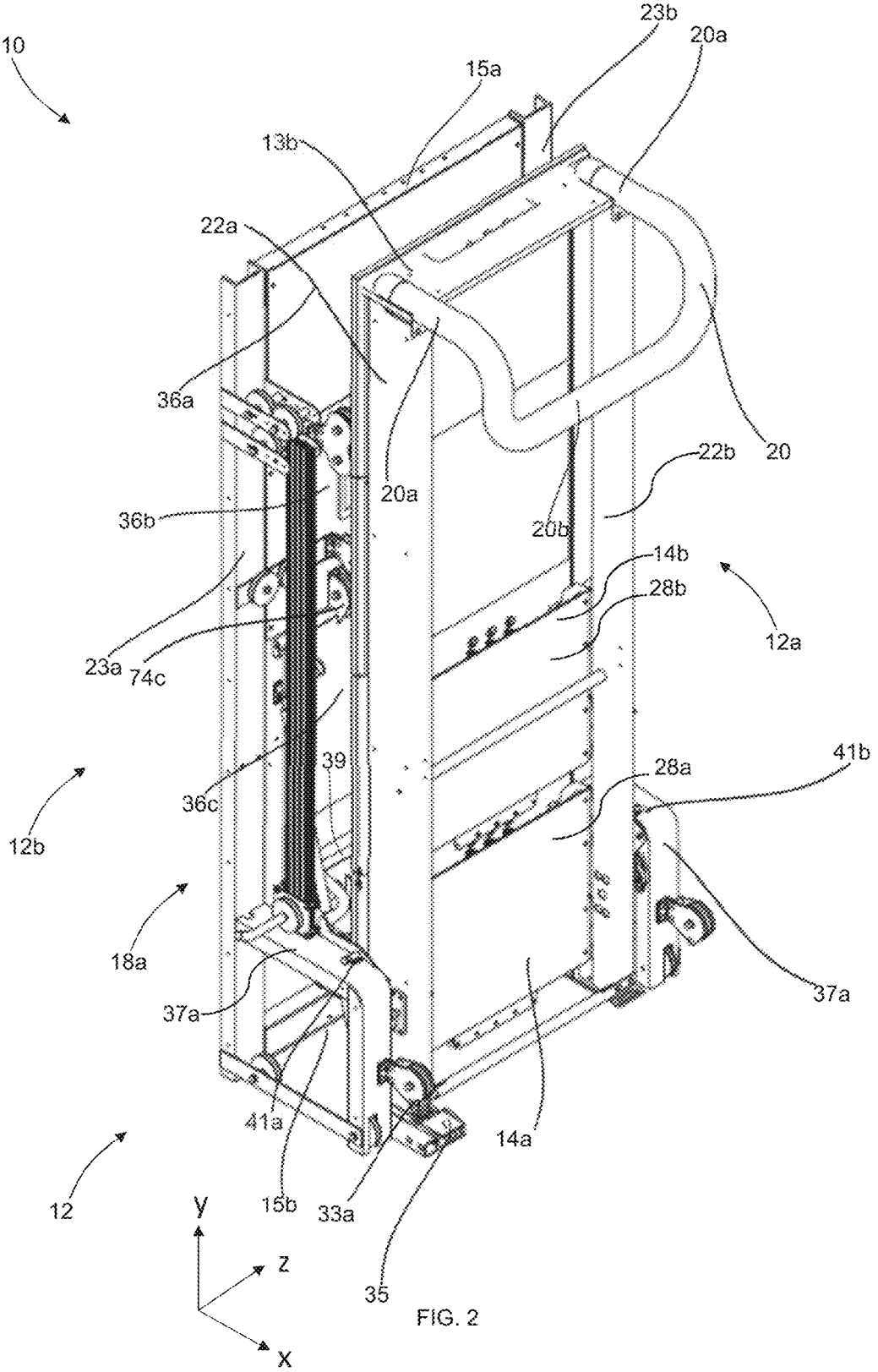
FIG. 2 is an isometric view of the exercise apparatus of FIG. 1 when a section of the exercise apparatus is in a vertical position.

The first frame section 12*a* is pivotable relative to the second frame section 12*b* between a generally horizontal position and a generally vertical position, as illustrated in FIG. 2. This results in a more space efficient exercise apparatus 10, which is especially useful when performing certain exercises using the second resistance system 18. A pivot mechanism 31*a*, 31*b* is provided in order to facilitate pivoting of the first frame section 12*a* into the generally vertical position. In this embodiment, the pivot mechanism is a first bearing 31*a* and a second bearing 31*b*. In alternative embodiments, any suitable pivot mechanism may be used, for example a bush.

The frame 12 includes a securing mechanism for securing first frame section 12*a* in the vertical position. In this embodiment, the securing mechanism includes a latching member 33*a* and a retaining member 33*b*, however in alternative embodiments any suitable securing mechanism may be used, for example a pin. The latching member 33*a* is located on the second frame section 12*b*, and the retaining member 33*b* is located on the first frame section 12*a*. The latching member 33*a* and the retaining member 33*b* are positioned such that when the first frame section 12*a* is pivoted into the vertical position, the latching member 33*a* is retained within the retaining member 33*b*.

The latching member 33*a* is biased into a latched position by a spring. The retaining member 33*b* moves past the latching member 33*a* as the first frame section 12*a* is pivoted from horizontal to vertical, and forces the latching member 33*a* into an unlatched position. Once the retaining member 33*b* has moved past the latching member 33*a*, the force from the spring pivots the latching member 33*a* into the latched position and the retaining member 33*b* is secured in the latched position. A pedal 35 is provided to pivot the latching member 33*a* into the unlatched position and release the retaining member 33*b*. The securing mechanism may be provided at either side of the frame 12, or alternatively two securing mechanisms may be provided, one at each side of the frame.

The securing mechanism improves the safety of the exercise apparatus 10. This is particularly advantageous when the first frame section 12*a* is in the vertical position and the exercise performed by the user exerts a downward force on the first frame section 12*a*.

The pivoting action may be assisted by a gas strut 45*a*, 45*b* or the like that is arranged to counteract the weight of the first frame section 12*a* so a user does not need to lift its full weight themselves.

The first frame section 12*a* includes a leg 20, a first frame member 22*a* and a second frame member 22*b*, and a first ledge 30*a* and a second ledge 30*b*. However, in alternative embodiments any of combination of these features may be included/omitted.

The first frame member 22*a* and the second frame member 22*b* extend in the generally horizontal direction and are spaced apart in the z-direction. The first and second frame members 22*a*, 22*b* of this embodiment are elongate parallel beams, however any suitable frame member may be used. The first and second ledges 30*a*, 30*b* extend from the first and second frame members 22*a*, 22*b* respectively towards a central longitudinal axis of the first frame section 12*a*.

The leg 20 extends from the second end 13*b* of the first frame section 12*a*. The leg 20 includes a section 20*a* extending in the generally vertical direction towards the floor. This means that the first frame section 12*a* is raised off the floor. In this embodiment, the leg 20 also includes a second frame section 20*b* extending in the z-direction. As well as supporting the first frame section 12*a*, the leg 20 enables the user to perform additional exercises when the first frame section 12*a* is in the vertical position, for example a pull up.

The second frame section 12*b* includes a first frame member 23*a*, a second frame member 23*b*, at least one vertical panel 36*a-c*, a monitor 47, a handle beam 39, a first support arm 37*a* and a second support arm 37*b*. However, in alternative embodiments any of combination of these features may be included/omitted.

The first and second frame members 23*a*, 23*b* extend in the generally vertical direction. In this embodiment, the first and second frame members 23*a*, 23*b* are elongate beams, however any suitable frame member may be used. The first and second frame members 23*a*, 23*b* are spaced apart in the z-direction so as to define a space 56 therebetween.

In this embodiment, a first panel 36*a*, a second panel 36*b* and a third panel 36*c* are provided, however any suitable number of panels may be used. A plane of each of the panels 36*a*, 36*b* is substantially parallel to the vertical direction. The first, second and third panels 36*a-c* are located in the space defined between the first and second frame members 23*a*, 23*b*. A width of each of the first, second and third panels 36*a*, 36*b*, 36*c* is approximately equal to a distance between the first and second frame members 23*a*, 23*b*.

The first panel 36*a* is located towards the first end 15*a* of the second frame section 12*b*. The second panel 36*b* is located below the first panel 36*a*. The third panel 36*c* is located below the second panel 36*c*. The panels 36*a-c* connect the first and second frame members 23*a*, 23*b* together to provide strength and rigidity to the second frame section 12*b*.

The monitor 47 is located on the second panel 36*b*, however in alternative embodiments the monitor 47 may be located anywhere on the second frame section 12*b*. Alternatively, the monitor may be provided separately to the frame, for example to the side of the frame. The monitor 47 may be used to show pre-recorded exercise classes. The monitor 47 is located so as to maximise visibility for the greatest range of possible exercises.

The third panel 36*c* is used to assist the user with certain exercises and may be referred to as a kick board or jump board. For example, the user can perform a squat jump off the third panel 36*c* by placing their feet on the third panel 36*c* and pushing off. The third panel 36*c* is covered with a deformable material, for example a foam, to improve user comfort. It shall be appreciated that in an alternative embodiment, a single panel may be provided which incorporates all of the functions of the first, second and third panels.

The handle beam 39 is mounted to the second frame section 12*b*, however in alternative embodiments the handle beam may be mounted at any suitable location on the frame, for example towards the first end 13*a* of the first frame section 12*a*. The handle beam 39 assists the user when performing certain exercises. The handle beam 39 is pivotable relative to the frame 12 between a generally vertical position and a generally horizontal position. Advantageously, this means the handle beam 39 can be pivoted out of the way of the user when it is not needed to perform the exercise. In this embodiment, bushes are used to connect the handle beam 39 to the frame 12, however any suitable component may be used, for example a bearing.

The pivot axes of the handle beam 39 and first frame section 12*a* are independent of one another. This helps to prevent the handle beam 39 from obstructing the pivoting of the first frame section 12*a* into the vertical position.

The handle beam 39 includes a section 39*a* extending in the direction perpendicular to the longitudinal axes of the first and second frame sections 12*a*, 12*b*. In this embodiment, the handle beam 39 is substantially U-shaped. The handle beam 39 enables the user to perform additional exercises, for example by pushing off the handle beam 39 with the hands or feet.

The handle beam 39 includes at least one hole to facilitate the securing of the handle beam 39 in the generally vertical position using a retaining mechanism 41. The retaining mechanism 41*a*, 41*b* includes a first retaining member 41*a* and a second retaining member 41*b* located on opposing sides of the frame 12. The first and second retaining members 41*a*, 41*b* are located within the holes in the handle beam 39 when the handle beam 39 is in the vertical position in order to secure the handle beam 39 in the vertical position. The first retaining member 41*a* is spring loaded. This means that when the first retaining member 41*a* is aligned with a hole in the handle beam 39, the spring forces the retaining member 41*a* into the hole. The second retaining member 41*b* is manually inserted into the hole in the handle beam 39. In alternative embodiments, any suitable mechanism may be used to secure the handle beam, or both of the retaining members may be spring-loaded/manually operated.

The first and second support arms 37*a*, 37*b* extend from opposing sides of the second frame section 12*b*. The first frame section 12*a* is located between the first and second support arms 37*a*, 37*b*. In this embodiment, the first and second support arms 37*a*, 37*b* extend from the first and second frame members 23*a*, 23*b* and are substantially L-shaped. A first section of each of the first and second support arms 37*a*, 37*b* extends in the horizontal direction. A second section of each of the first and second support arms 37*a*, 37*b* extends in the vertical direction. In this embodiment, a vertical height of the first and second support arms 37*a*, 37*b* is approximately equal to a vertical height of the first frame section 12*a*. This helps to prevent the frame 12 from obstructing the user.

The pivot mechanism 31*a*, 31*b*, in this embodiment the first and second bearing, are mounted to the frame 12 via the first and second support arms 37*a*, 37*b*. The securing mechanism, the handle beam 39 and the retaining mechanism 41 are also mounted to frame 12 via the support arms 37*a*, 37*b*. The first and second support arms 37*a*, 37*b* are also used to mount additional components of the exercise apparatus to the frame, as described in more detail below. Therefore, the configuration of the support arms 37*a*, 37*b* provides a compact way on mounting a range of components to the frame 12, with minimal obstruction to the user.

Figure 3:
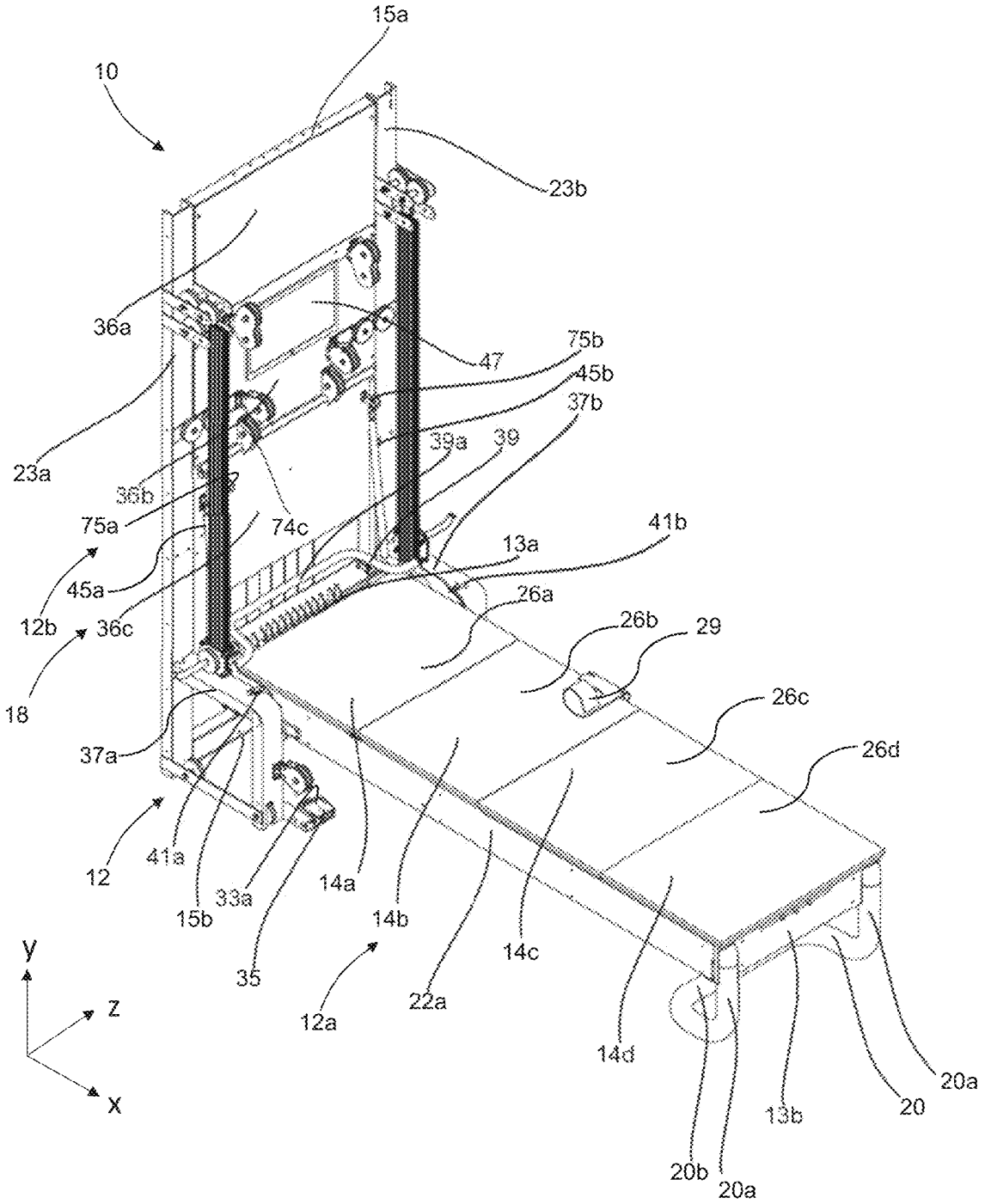
FIG. 3 is an isometric view of the exercise apparatus of FIG. 1 when a full platform has been assembled.

In this embodiment, the exercise apparatus 10 includes a first carriage 14*a* and a second carriage 14*b* for supporting the user. As illustrated in FIG. 3, an additional third carriage 14*c* and a fourth carriage 14*d* are provided, however in alternative embodiments any number of carriages may be used. The first and second carriages 14*a*, 14*b* are 'slidable' carriages, and the third and fourth carriages 14*c*, 14*d* are 'fixed' carriages. As illustrated in FIG. 1, the third and fourth carriage 14*c*, 14*d* are removable. An axial length of the first frame section 12*a* is approximately equal to a total length of the four carriages 14*a-d* in the same direction. A width of the first frame section 12*a* is approximately equal to a width of each of the four carriages 14*a-d*. This means that when all four carriages are assembled on the frame, movement of the carriages is restricted in the y and z directions.

The first carriage 14*a* and the second carriage 14*b* are slidably supported on the first frame section 12*a* of the frame. Additionally, the first carriage 14*a* can be slidable relative to the second carriage 14*b*. The first and second carriages 14*a*, 14*b* can also be secured together such that the first and second carriages 14*a*, 14*b* act as one body. Any suitable mechanism may be used to secure the first and second carriages 14*a*, 14*b*, for example a latch.

Figure 4:
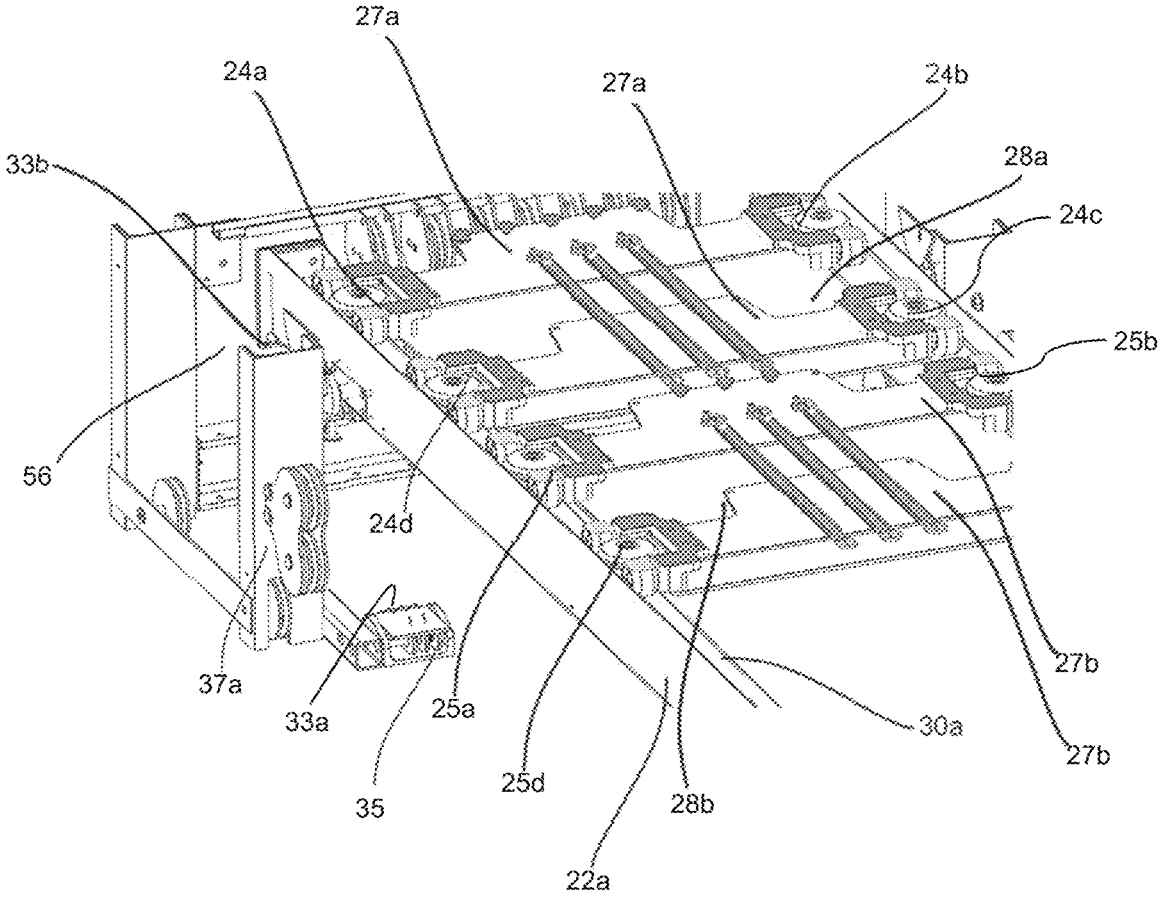
FIG. 4 is detailed section view of the exercise apparatus of FIG. 1.

As illustrated in FIG. 4, the carriages 14*a*, 14*b* are slidably supported on the ledges 30*a*, 30*b* of the first and second frame members 22*a*, 22*b*.

The first and second carriages 14*a*, 14*b* each include at least one set of wheels 24*a-d*, 25*a-d* for slidably engaging with the first and second rails 22*a*, 22*b*. In this embodiment, the first and second carriages 14*a*, 14*b* are each provided with four sets of wheels, 24*a-d*, 25*a-d*. The sets of wheels 24*a-d*, 25*a-d* are located at opposing ends of outer edges of the first and second carriages 14*a*, 14*b*. Advantageously, the locations of the wheels uniformly supports the weight of the user and helps to prevent the carriages 14*a*, 14*b* from tipping relative to the first frame section 12*a*.

In this embodiment, each set of wheels includes two axial wheels and one alignment wheel, as illustrated in FIG. 4. The axial wheels rotatably engage with the respective first and second ledges 30*a*, 30*b* so as to facilitate the movement of the carriages in the horizontal direction. The alignment wheel is located in between the two axial wheels. The alignment wheel rotatably engages with a side wall of each of the respective first or side frame member 22*a*, 22*b*. This has the advantages of improving the smoothness as the carriages 14*a*, 14*b* slide relative to the frame 12.

It shall be appreciated that in alternative embodiments, any suitable mechanism for slidably supporting the carriages on the frame may be used, for example a belt and roller system. Additionally, any suitable arrangement of wheels may be used, for example the aligning wheel may be omitted.

The second carriages 14*b* includes a removable support 29 for supporting the head and shoulders of the user when they perform an exercise. The removable support 29 helps to prevent the user from sliding along the carriages 14*a*, 14*b* towards the second end 13*b* when they perform a movement. Although only one removable support 29 is illustrated in the FIG. 3, it shall be appreciated that a first and second removable support could be provided at opposing sides of the first or second carriage. For reasons of conciseness and brevity, only the removable support 29 shall be described herein.

The removable support 29 includes a body 29 and a covering (not shown). The body 29 provides the structural strength required to support the user. The body 29 may be manufactured from a metallic material, such as an aluminium alloy. The covering is deformable, and therefore provides a cushioning effect to improve user comfort. The covering may be manufactured from a foam, or any other suitable material.

A portion of the support 29 extends over an upper surface of the first and/or second carriage 14*a*, 14*b*, and a portion extends in the vertical direction. The support 29 also includes a groove extending in the horizontal direction which partially receives the first or second carriage 14*a*, 14*b*. The support is secured into place using pins (not shown). It shall be appreciated that in alternative embodiments, any suitable arrangement of support may be used.

The third and fourth carriages 14*c*, 14*d* are fixed carriages, meaning they do not include wheels. The third and fourth carriages 14*c*, 14*d* are located towards the second end 13*b* of the first frame section 12*a*. However, in alternative embodiments, both the third and fourth carriage 14*c*, 14*d* may be located at the first end 13*a*, at one at either end 13*a*, 13*b* of the first frame section 12*a*.

As discussed above, when the third are fourth carriages 14*c*, 14*d* are assembled in the fixed position on the first frame section 12*a* of the frame 12, they restrict the movement of the slidable carriages 14*a*, 14*b*. This means the user can perform exercises on a stationary base, which increases the versatility of the exercise apparatus 10. Additionally, this provides a larger base compared to the first and second carriages 14*a*, 14*b* only, and helps to prevent the user from falling off the first and second carriages 14*a*, 14*b* into the space defined between the first and second frame members 22*a*, 22*b*.

The carriages 14*a-d* each include a first generally planar top panel 26*a-d*. The top panels 26*a-d* support the user, and are therefore at least partially covered with a padded material, for example a foam. This increases the level of comfort experienced by the user.

The first and second carriages 14*a*, 14*b* also includes a generally planar base panel 28*a*, 28*b* and a plate 27*a*, 27*b*. Advantageously, the base panels 28*a*, 28*b* hide components of the exercise apparatus 10 from view when the first section 12*a* is in the vertical position. The planes of the top panels 26*a-d* and base panels 28*a*, 28*b* are parallel. The top panels 26*a*, 26*b* and the base panels 28*a*, 28*b* are spaced apart so as to define a space therebetween. The plates 27*a*, 27*b* are located in the space between the top panels 26*a*, 26*b* and the base panels 28*a*, 28*b*.

It shall be appreciated that in alternative embodiments, any suitable arrangement of panels and/or plates may be used to assemble the carriage.

Figure 5:
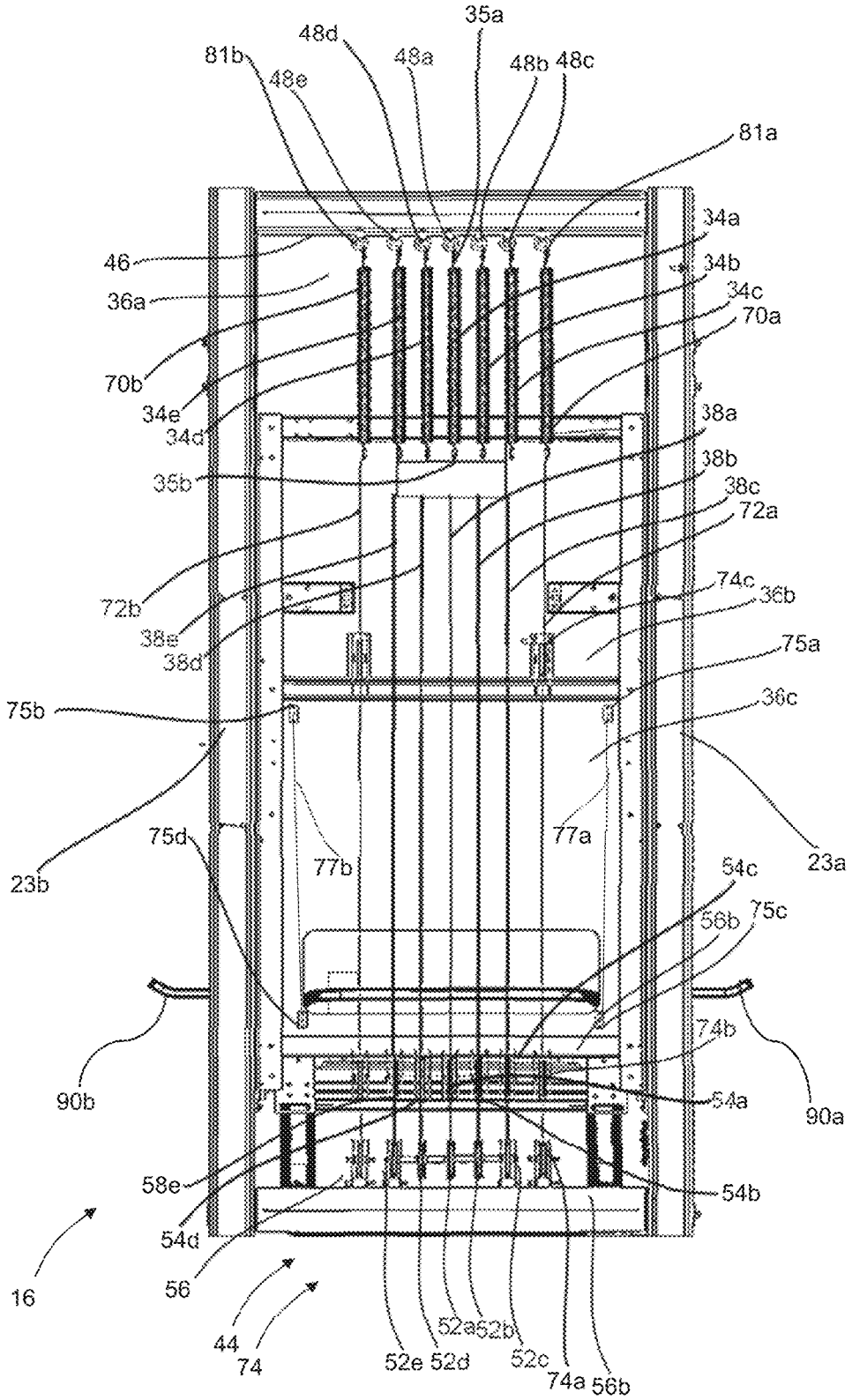
FIG. 5 is a back view of part of a first resistance system of FIG. 1.
Figure 6:
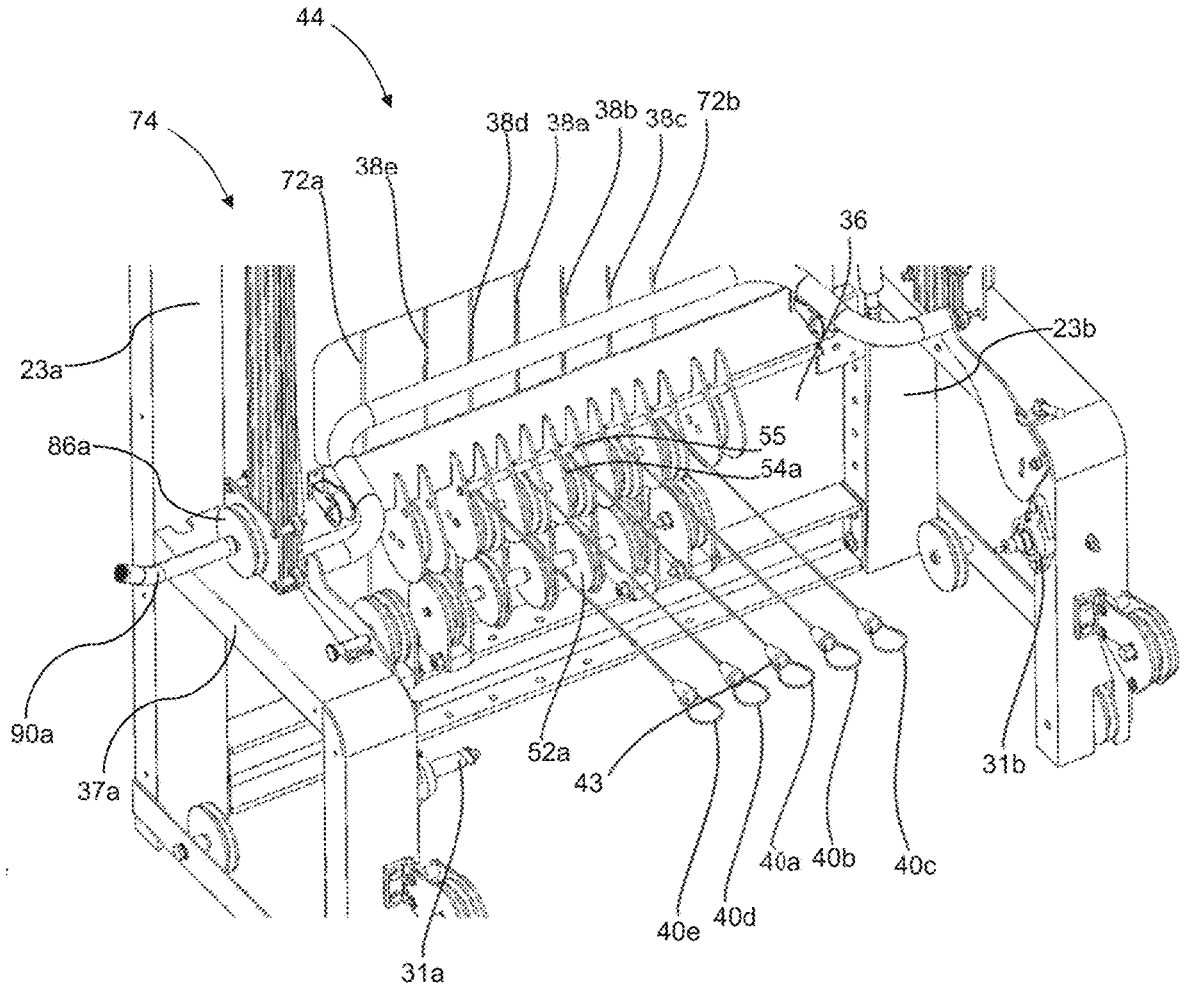
FIG. 6 is a detailed view of a pulley system of the exercise apparatus of FIG. 1.

With reference to FIGS. 5 and 6 in particular, the first resistance system 16 includes a first resilient member 34*a* removably connected to at least one of the carriages 14*a*, 14*b* and/or the frame 12, as illustrated in FIG. 5. The first resistance system 16 also includes a connecting member 38*a*, a first attachment device 40*a*, a first attachment location 42 and a pulley system 44. In this embodiment, a first end 35*a* of the first resilient member 34*a* is removably connected to the carriage 14*a*, and a second end 35*b* of the resilient member 34*a* is connected to the first carriage 14*a* via the connecting member 38*a*. However, in alternative embodiments, the first resilient member may be removably connected to the second carriage and/or to the second section.

The first resistance system 16 is used for variable resistance training. As the carriage 14*a* is displaced relative to the frame 12, a tensile force is exerted on the resilient member 34*a*. As the displacement increases, the tensile force exerted on the resilient member increases, hence the resistance felt by the user varies throughout the movement. Variable resistance training has the benefits of increasing resistance when the muscles are at their strongest point in the movement. This can have increased strength benefits because the user is not limited by the maximum strength at the weakest point in the movement. Additionally, the risk of injury has been found to be lower for variable resistance training.

An example of a movement which benefits from the addition of variable resistance is a leg press. To perform a leg press, the user lies with their back flat on the carriages 14*a* and 14*b*, their legs bent and their feet positioned against the first end 13*a* of the first section frame 12*a*. The user pushes against the third panel 36*c* and extends their legs. This causes the carriage 14*a* to move towards the second end 13*b* of the frame 12, and for the resilient member 34*a* to lengthen and exert a variable resistance on the carriage 14*a*. It shall be appreciated that this is one example of a wide range of exercises that can be performed on the exercise apparatus 10.

The first resilient member 34*a* includes a first end 35*a* and a second end 35*b*, and is located on the second section 12*b*. The first resilient member 34*a* extends in a generally vertical orientation. In this embodiment, the first resilient member 34*a* is spaced apart from the first end 13*a* of the first section 12*a* in the vertical direction and is located substantially centrally on the second section 12*a* in the z-direction. In alternative embodiments, the first resilient member may be located at any suitable location on the frame.

The first end 35*a* of the first resilient member 34*a* is located towards the first end 15*a* of the second section 12*b*. In this embodiment, the first end 35*a* of the resilient member 34*a* is connected to a cross member 46 which extends along the x-axis in a direction away from the first section 12*a*. The first end 35*a* of the first resilient member 34*a* is hooked, and a ring 48*a* is fastened to the cross member 46 using a threaded fastener. To connect the resilient member 34*a* to the second section 12*b*, the hooked end 35*a* is located within the ring 48*a*. It shall be appreciated that in alternative embodiments, any suitable mechanism for connecting the resilient member 34*a* to the frame 12 may be used, and the ledge, ring and/or hooked end may be omitted. For example, the rings may be directly fastened to the second section without the ledge.

The second end 35*b* of the first resilient member 34*a* is connected to the first carriage 14*a* via the connecting member 38*a*. However, in alternative embodiments the resilient member 34*a* may be directly connected to the first or second carriage 14*a*, 14*b*. The connecting member 38*a* extends in the generally vertical direction, and is substantially coaxial with the resilient member 34*a* when the connecting member 38*a* is under tension.

In this embodiment, the connecting member 38*a* is a cable, however in alternative embodiments any suitable member may be used, for example a cord or a rope. The connecting member 38*a* is inextensible, meaning that displacement of the carriage 14*a* causes negligible lengthening of the connecting member 38*a*. This means the resistance transferred by the connecting member 38*a* is negligible compared to the resistance transferred by the resilient member 34*a*.

To connect the resilient member 34*a* to the connecting member 38*a*, the second end 35*b* is hooked, and the connecting member 38*a* is tied to the hooked end 35*b*. In alternative embodiments, any suitable connection may be used.

As illustrated in FIG. 6, the connecting member 38*a* also includes the attachment device 40*a* located at an end of the connecting member 38*a*. In this embodiment, the attachment device 40*a* is a loop, however any suitable attachment device may be used. The loop 40*a* includes a clasp 43, for example a toggle, for securing the loop and retaining the loop in the correct position when the user exerts the tensile force on the connecting member 38*a*.

The carriage 14*a* includes the first attachment location 42, however in alternative embodiments the first attachment location 42 may be located on the second carriage 14*b*, or on the frame 12. The first attachment location 42 is used to connect the connection member 38*a* to the first carriage 14*a*.

Figure 7:
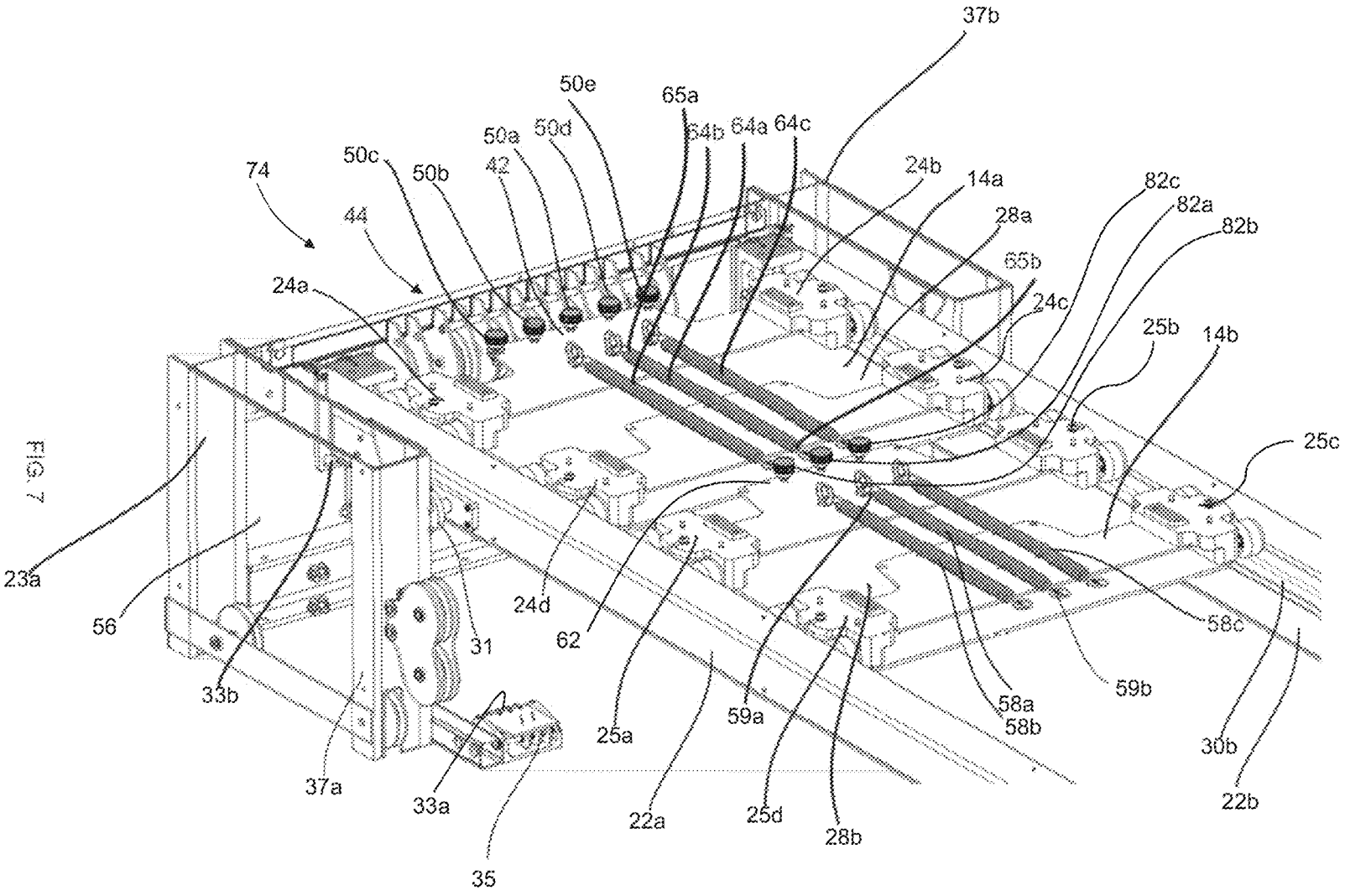
FIG. 7 is a detailed section view of a part of the first resistance system of FIG. 1.

In this embodiment, the first attachment location 42 is positioned at least partially beyond an upper edge of an upper surface of the carriage 14*a*, as illustrated in FIG. 7. This improves the visibility of the attachment location 42 and helps to prevent the attachment location 42 from obstructing the user when they perform an exercise. In this embodiment, the attachment location 42 is a protruded edge extending from the plate 27*a* of the first carriage 14*a*, however in alternative embodiments the attachment location may be positioned anywhere on the first or second carriage, for example on the top or bottom panels.

The attachment location 42 includes an attachment point 50*a* extending from the attachment location 42. In this embodiment, the attachment point 50*a* is spherical, however any suitable shape may be used. To connect the connecting member 38*a* to the attachment location 42, the attachment device 40*a* engages with the attachment point 50*a*. When the user wants to connect the resilient member 34*a* to the carriage 14*a*, the loop 40*a* engages behind a base of the attachment point 50*a*. Alternatively, any suitable mechanism for connecting the connecting member to the first carriage may be used, for example a pin.

The connecting member 38*a* enables the user to connect the resilient member 34*a* to the first carriage 14*a* without having to touch the resilient member 34*a*. This reduces the likelihood of entrapment of a body part, and therefore increases the safety level of the exercise apparatus. Additionally, the use of the attachment point 50*a* and the attachment device 40*a* provides a simple way for the user to connect and remove the resilient member 34*a* depending on the amount of resistance required to perform the exercise.

Figure 8:
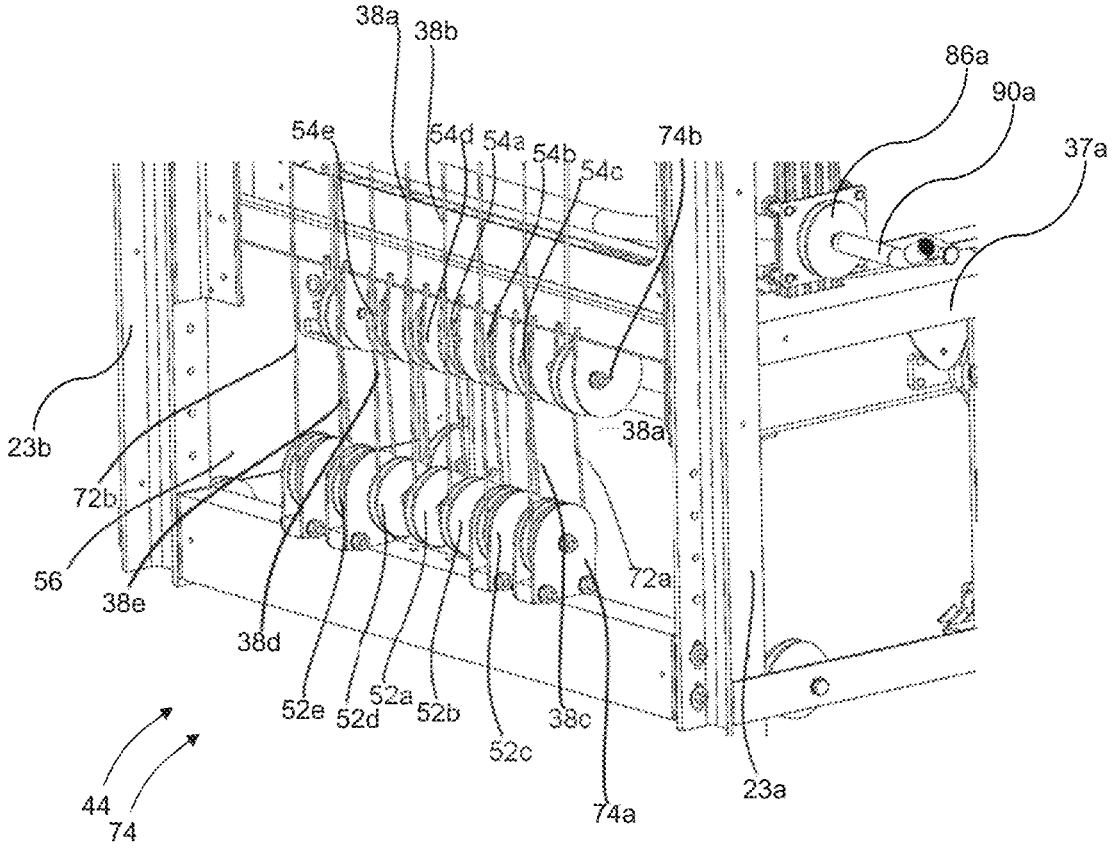
FIG. 8 is a detailed view of the pulley system of FIG. 6.

In this embodiment, the pulley system 44 is used to transfer the tensile force from the carriage 14*a* to the resilient member 34*a*, as illustrated in FIG. 8. The pulley system 44 includes a first pulley 52*a* and a second pulley 54*a*. In alternative embodiments, any suitable number of pulleys may be used, or the pulley system may be omitted altogether.

The pulley system 44 is located in the space 56 of the second section 12*b*. The pulley system 44 is located at the second end 15*b* of the second section 12*b*, however in alternative embodiments the pulley system 44 may be located anywhere on the frame 12. The first pulley 52*a* is mounted on a lower bracket 56*a* extending in the z-direction, and the second pulley 54*a* is mounted on an upper bracket 56*b* extending in the x-direction. The connecting member 38*a* extends through the first pulley 52*a* and then through the second pulley 54*a*, before being connected to the first attachment location 42.

The second pulley 54*a* includes a stop 55 to help prevent the attachment device 40*a* from being pulled through the pulley 54*a*. In this embodiment, the stop 55 is a bar extending in a direction parallel to the axis of rotation of the pulley 52*a*. The stop 55 is arranged so as to allow the connecting member 38*a* to pass underneath the stop, but to prevent the clasp 43 from passing underneath the stop.

As illustrated in FIG. 5, in this embodiment a first set of resilient members 34*a-e* is provided. In the embodiment, the set includes five resilient member 34*a-e* for transferring resistance to the first carriage 14*a*, however in alternative embodiments any suitable number of resilient members may be used. It shall be appreciated that each of the resilient members 34*b-e* are of substantially the same configuration as the resilient member 34*a*. There is also a connecting member 38*b-e*, attachment device 40*b-e*, pulley system 44*b-e*, attachment point 50*a-e* and ring 48*a-e* associated with each of the resilient members 34*b-e* of substantially the same configuration as described above.

Each of the first resilient members 34*a-e* are located adjacent one another and spaced apart in the z-direction. The first resilient members 34*a-e* are located behind the vertical panels 36. This keeps the resilient members 34*a-e* out of the way of the user and hides them from view, which improves the aesthetics of the exercise apparatus 10. The attachment points 50*a-e* and the pulley systems 44 are also located adjacent one another and spaced apart in the z-direction. The spacing between the first resilient members 34*a-e*, the pulley systems 44 and the attachment points 50*a-e* is approximately equidistant. This means that the resilient members 34*a-e* and the connecting members 38*a-e* are substantially parallel to one another. This helps to prevent the resilient members 34*a-e* and/or connecting members 38*a-e* from becoming entangled during use of the exercise apparatus 10.

As the resilient members 34*a-e* are removably connectable to the carriage 14*a*, different members of the set of resilient members 34*a-e* may be connected to the carriage 14 in different combinations. This increases the range of resistance levels available to the user, and therefore makes the exercise apparatus suitable for a range of abilities and a range of fitness goals. The stiffness of each of the resilient members 34*a-e* may vary. For example, the stiffness (spring rate) of each of the resilient members may progressively increase. This further increases the resistance levels available to the user.

The attachment devices 40*a-e* and attachment points 50*a-e* may be colour coded depending on the stiffness (spring rate) of the resilient members 34*a-e* in order to simplify the attachment process for the user. For example, there may be four different colours of attachment device and attachment point corresponding to four different stiffness values. This may be particularly advantageous if the exercise apparatus is being used during a class. In alternative embodiments, the attachment points and attachment devices associated with each resilient member may be labelled, for example using a numbering system.

Figure 9:
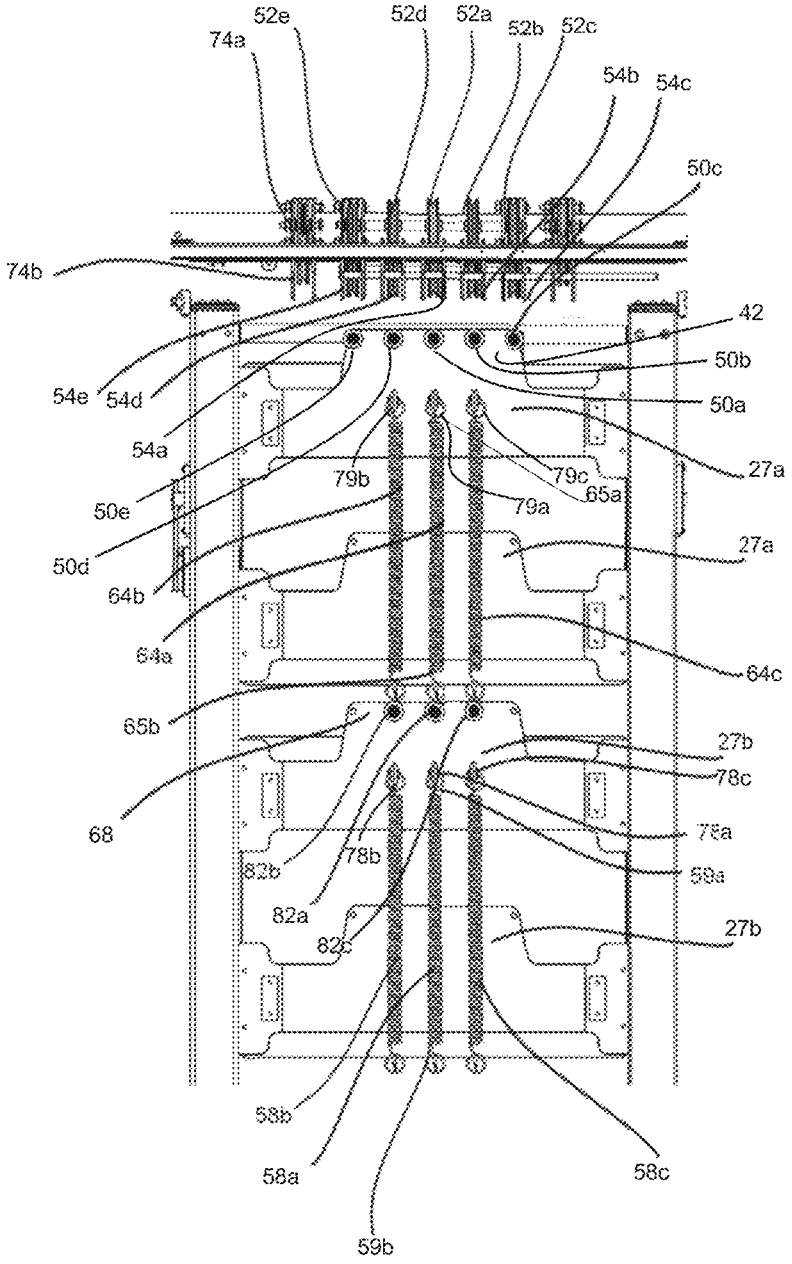
FIG. 9 is a top view of the part of the first resistance system of FIG. 7 along the same section as FIG. 7.
Figure 10:
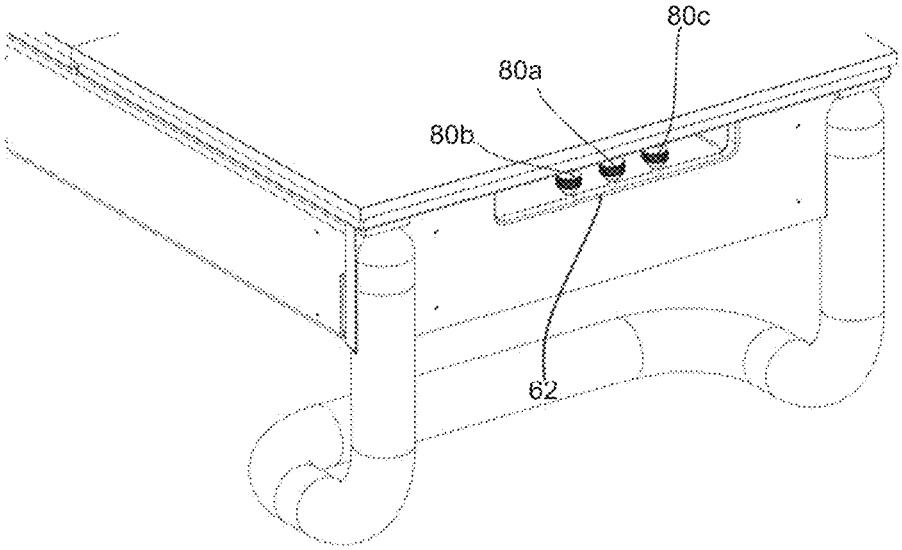
FIG. 10 is a detailed isometric view of an attachment location of the exercise apparatus of FIG. 1.

In this embodiment, the first resistance system 16 also includes a second resilient member 58*a*, a second attachment device and a second attachment location 62. The first resistance system 16 also includes a third resilient member 64*a*, a third attachment device (not shown) and a third attachment location 68. The first resistance system also includes a fourth resilient member, a second connecting member 72*a* and a second pulley system 74. It shall be appreciated that in alternative embodiments, any suitable number of resilient members may be used or omitted. FIGS. 9 and 10 show the features associated with the second and third resilient members 58*a*, 64*a*. For clarity purposes, only the components of the first resistance system 16 are labelled in FIGS. 9 and 10.

The second resilient member 58*a* is removably connected between the second end 13*b* of the first section 12*a* and the second carriage 14*b*. This provides a second tensile force in an opposing direction to the first tensile force, which increases the range of exercises the user can perform. Additionally, the provision of the second resilient member 58*a* increases the number of possible resistance levels selectable by the user.

The second resilient member 58*a* includes a first end 59*a* and a second end 59*b*, and extends in a generally horizontal orientation. In this embodiment, the second resilient member 58*a* is supported on an underside of the second carriage 14*a*. This retains the second resilient member in the correct position when the first section 12*a* is pivoted into the vertical position.

The second resilient member 58*a* is supported on the plate 27*b* located between the top panel 26*b* and the bottom panel 28*b*. In alternative embodiments, the second resilient member may be located anywhere on the first or second carriage, or instead on the frame. Alternatively, the plate may be omitted and any suitable support may be used.

The second resilient member is housed within a channel (not shown) located on the underside of the second carriage 14*b*. The channel extends in the direction parallel to the longitudinal axis of the first section 12*a*, and is substantially rectangular. The channel is manufactured from a sound absorbent material, for example a felt. This reduces the level of noise as the second resilient member extends and contracts.

The first end 59*a* of the second resilient member 58*a* is connected to the underside of the second carriage 14*b* in substantially the same way as the first end 35*a* of the first resilient member 34*a*. A ring 78*a* is fastened to the second carriage 14*b*, in this embodiment to the plate 27*b* of the second carriage 14*b*. The first end 59*a* is hooked, and the hooked end 59*a* is located within the ring 78*a* to connect the second resilient member 58*a* to the second carriage 14*b*.

The second end of the second resilient member 58*a* is connected to the first section 12*a* of the frame 12 via the second attachment device (not shown). The second attachment device is of substantially the same configuration to the first attachment device 40*a-e*. The second attachment device is connected to the second end 59*b*. The second attachment device of this embodiment is a loop, however any suitable attachment device may be used. Alternatively, the second attachment device may be omitted and the resilient member 58*a* may be directly connected the second attachment location 62.

The first section 12*a* of the frame 12 includes the second attachment location 62, however in alternative embodiments, the second attachment location 62 may be located on the first or second carriage 14*a*, 14*b*. The second attachment location 62 is used to connect the second attachment device to the first section 12*a*, and therefore connect the second resilient member 58*a* to the first section 12*a*.

Similarly to the first attachment location 42, the second attachment location 62 includes an attachment point 80*a* of substantially the same configuration. The attachment device engages behind a base of the second attachment point 80*a* in order to securely connect the second resilient members 58*a* to the second end 13*b* of the first section 12*a*.

As illustrated in FIG. 7, in this embodiment a set of resilient members 58*a-c* is provided. In this embodiment the second set includes three resilient members 34*a-c* for transferring resistance to the second carriage 14*b*, however in alternative embodiments, any suitable number of resilient members may be used. It shall be appreciated that each of the second resilient members 58*b-c* are of substantially the same configuration as the resilient member 58*a*. There is also an attachment device, an attachment point 80*b*, 80*c* and a channel (not shown) associated with each of the resilient members 58*b*, 58*c* of substantially the same configuration.

Each of the second resilient members 58*a-c*, and therefore each of the channels, are located adjacent one another and spaced apart in the z-direction. The attachment points 80*a-c* are also located adjacent one another and spaced apart in the z-direction. The spacing between the attachment points 80*a-c* and the second resilient members 58*a-c* is substantially the same such that the second resilient members 58*a-c* are parallel both when connected to and separate from the frame 12.

As the second resilient members 58*a-c* are removably connectable to the first section 12*a*, different combinations of resilient members 58*a-c* may be connected to the first section 12*a*. This increases the range of resistance levels available to the user, and therefore makes the exercise apparatus suitable for a range of abilities and a range of fitness goals. Similarly to the first set of resilient members 34*a-e*, the stiffness (spring rate) of each of the resilient members 58*a-c* may vary. This further increases the resistance levels available to the user.

The third resilient member 64*a* is removably connected between the first carriage 14*a* and the second carriage 14*b*. This provides a third tensile force between the first and second carriages, which increases the range of exercises the user can perform. For example, the user can perform a lunge under variable resistance by positioning one foot on each of the first and second carriages 14*a*, 14*b* and lowering the back knee and the hips. This causes the first and second carriages 14*a*, 14*b* to move apart, and therefore for the third resilient member 64*a* to extend and exert a variable force on the first and second carriages 14*a*, 14*b*.

The third resilient member 64*a* includes a first end 65*a*, a second end 65*b* and extends in a generally horizontal orientation. In this embodiment, the third resilient member 64*a* is supported on an underside of the first carriage 14*a* in substantially the same arrangement as the second resilient member 58*a* is supported on the second carriage 14*b*. Therefore, the third resilient member 64*a* is supported on a plate 27*a* located between the top panel 26*a* and the base panel 28*a* in a channel (not shown). Additionally, the first end 65*a* is connected to the carriage 14*a* via a ring 79*a*.

The second end 65*b* of the third resilient member 64*a* is connected to the second carriage 14*b* via the third attachment device. The third attachment device is connected to the second end 59*b* of the third resilient member. The second carriage 14*b* includes the third attachment location 62 and the third attachment point 82*a*. The third attachment location 62 is positioned at least partially beyond an upper edge of an upper surface of the second carriage 14*b*. The configuration and connection of the third resilient member 64*a*, attachment device and attachment location 62 is substantially the same as the second resilient member 58*a* and the associated components.

As illustrated in FIG. 7, in this embodiment a set of resilient members 64*a-c* are provided. Three resilient members 64*a-c* are provided of substantially the same configuration and equivalent location to the second set of resilient members 58*a-c*.

The fourth set of resilient members 70*a*, 70*b* are of substantially the same configuration to the first resilient member 34*a*. As such, the fourth resilient members 70*a*, 70*b* are connected to the cross member 46 via rings 81*a*, 81*b* and extend in a generally vertical orientation. Additionally, the connection between the connecting members 72*a*, 72*b* and the fourth resilient member 70*a*, 70*b* are the same. The second connecting members 72*a*, 72*b* include a fourth attachment device (not shown). The fourth attachment device is suitable for attaching a handle or a loop. This enables the user to perform exercises, for example upper body exercise, using the variable resistance provided by the fourth resilient member 70*a*.

The second pulley system 74 is used to transfer the fourth tensile force from the fourth resilient members 70*a*, 70*b* using the same arrangement as the first pulley system 44. The second pulley system 74 also includes a third pulley 74*c*. The third pulley 74*c* is located towards the centre of the second section 14*b* on an opposing face to the first and fourth resilient members 34*a*, 70*a*. The connecting member 72*a* extends from the second pulley 74*b* in a generally upward direction and through the third pulley 74*c*. It shall be appreciated that in alternative embodiments, any suitable number and/or arrangement of pulley system may be used, or alternatively the pulley system may be omitted altogether.

In this embodiment, a fourth set of resilient members 70*a*, 70*b* is provided. The fourth resilient members 70*a*, 70*b* are located towards opposing sides of the second frame section 12*b*. This enables two handles to be attached to the fourth resilient members 70*a*, 70*b* such that the user can perform a greater range of exercises. This is particularly advantages when all four carriages 14*a-d* are assembled, as the user can perform exercises on a stationary platform using the variable resistance provided by the fourth resilient members 70*a*, 70*b*. The spacing between the fourth resilient members 70*a*, 70*b* has been found to be optimal for performing upper body exercises such as a standing row.

An additional attachment device 77*a*, for example a rope, is also be provided. The attachment device 77*a* is removably attachable at a first end to the attachment location 42, and extends through the pulley 75*a*, 75*c*. Handles, stirrups and the like (not shown) may be attached at a second end of the attachment device 77*a*. This enables the user to perform a greater range of exercises. For example, the user may use the rope to pull the carriage from the first end 13*a* towards the second end 13*b* against the resistance provided by the second resilient member 58*a*. A second attachment device 77*b*, for example a rope, of substantially the same configuration to the attachment device 77*a* may be provided which extends through the pulleys 75*b*, 75*d*.

The above arrangement provides the user with a wide range of possible spring combinations corresponding to a wide range of resistances. Additionally, exercise apparatus provides variable resistance acting in three directions. This creates a versatile exercise apparatus which is suitable for a range of abilities and fitness goals.

In this embodiment, all of the first, second, third and fourth resilient members 34*a-d*, 58*a-c*, 64*a-c*, 70*a-d* are springs, for example extension springs. In alternative embodiments, any suitable resilient member may be used, for example an elastomeric (rubber) cable. The provision of an elastomeric cable may be particularly advantageous for use in place of the fourth set of springs 70*a*, 70*b*. Alternatively, any combination of different resilient members may be used, for example some springs and some elastomeric cables.

Additionally, the location of the first, second, third fourth resilient members is not limited to that described above. For example, the locations of the springs and attachment locations may be reversed. In the case of the second resilient members, this would mean that the second resilient members were located on the frame 12 and the second attachment location located on the carriage 14. Similarly, the third resilient member may be located on the second carriage 14*b*, and the third attachment location on the first carriage 14*a*.

Figure 11:
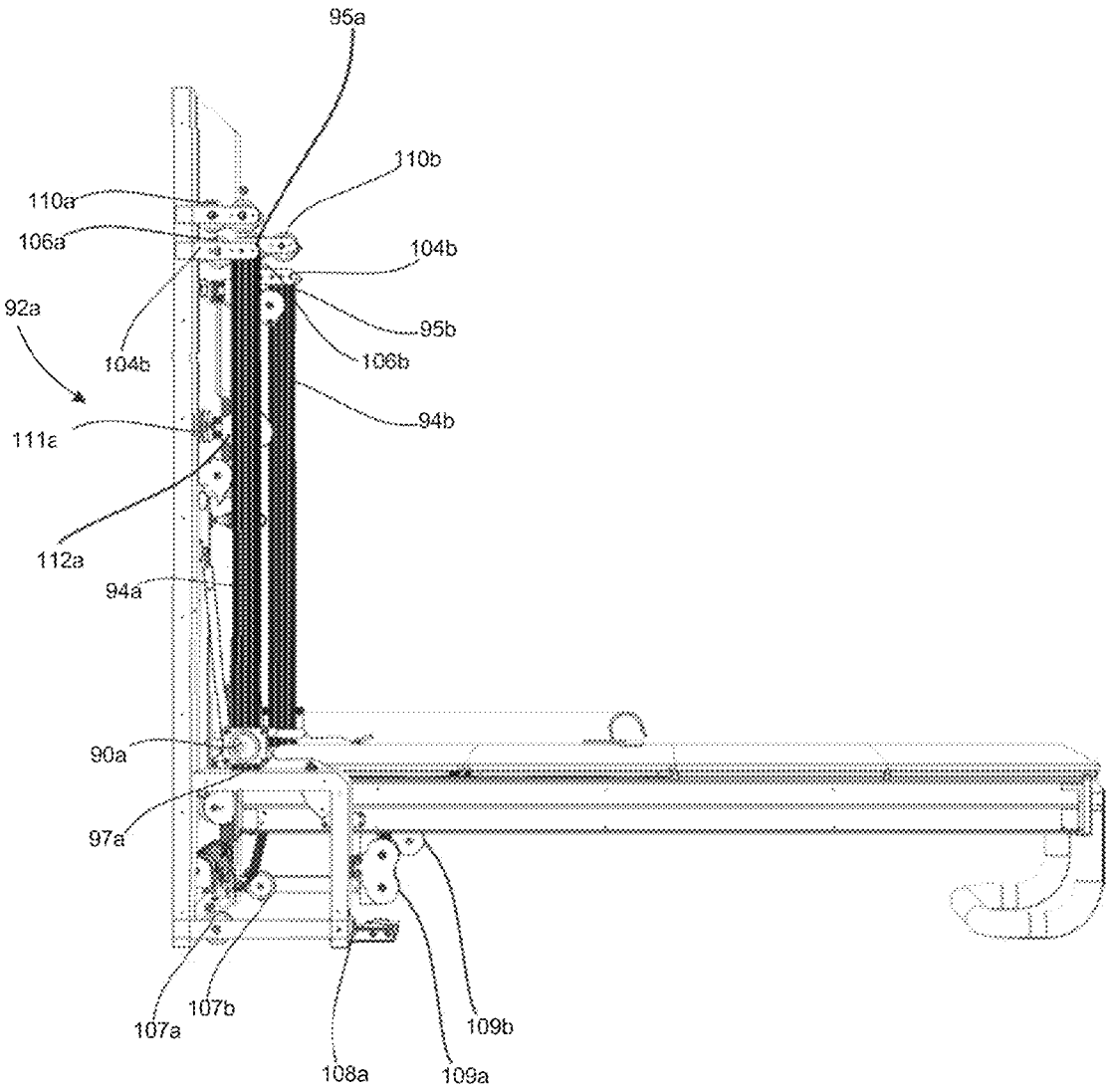
FIG. 11 is a side view of the exercise apparatus of FIG. 1.
Figure 12:
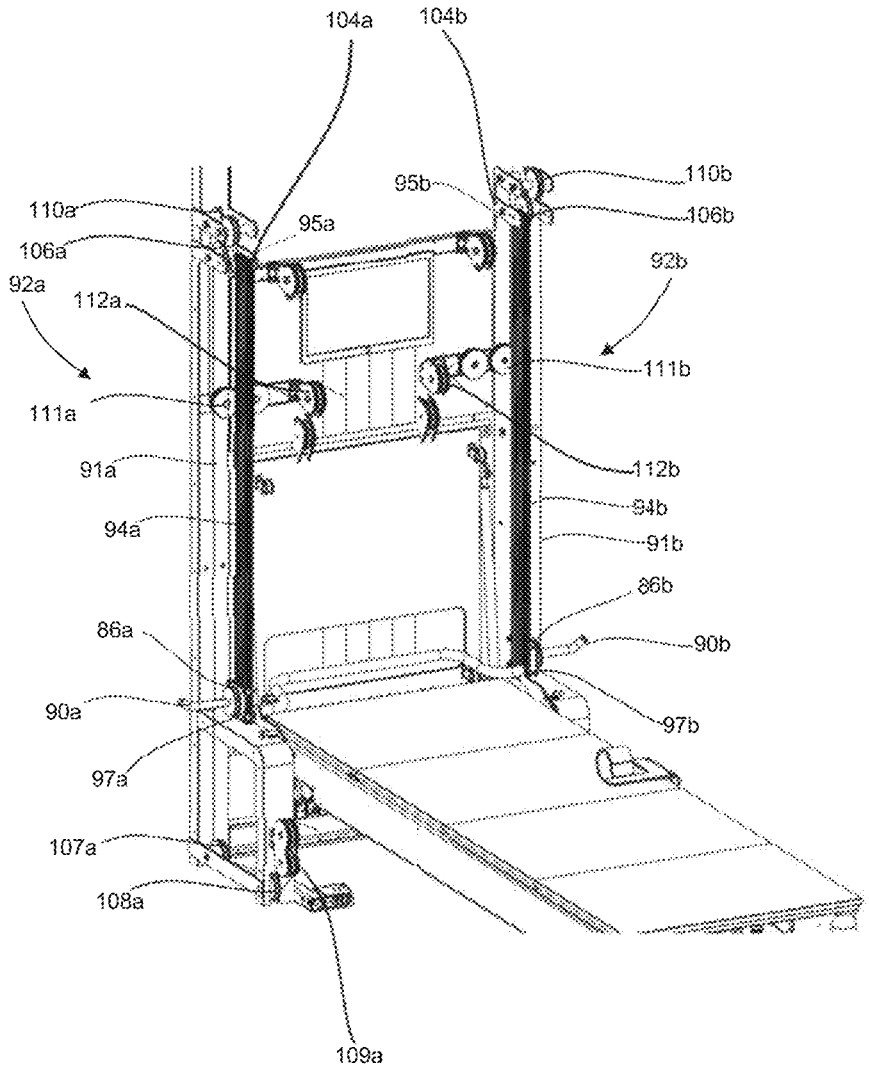
FIG. 12 is a detailed isometric view of a second resistance system of the exercise apparatus of FIG. 1.
Figure 13:
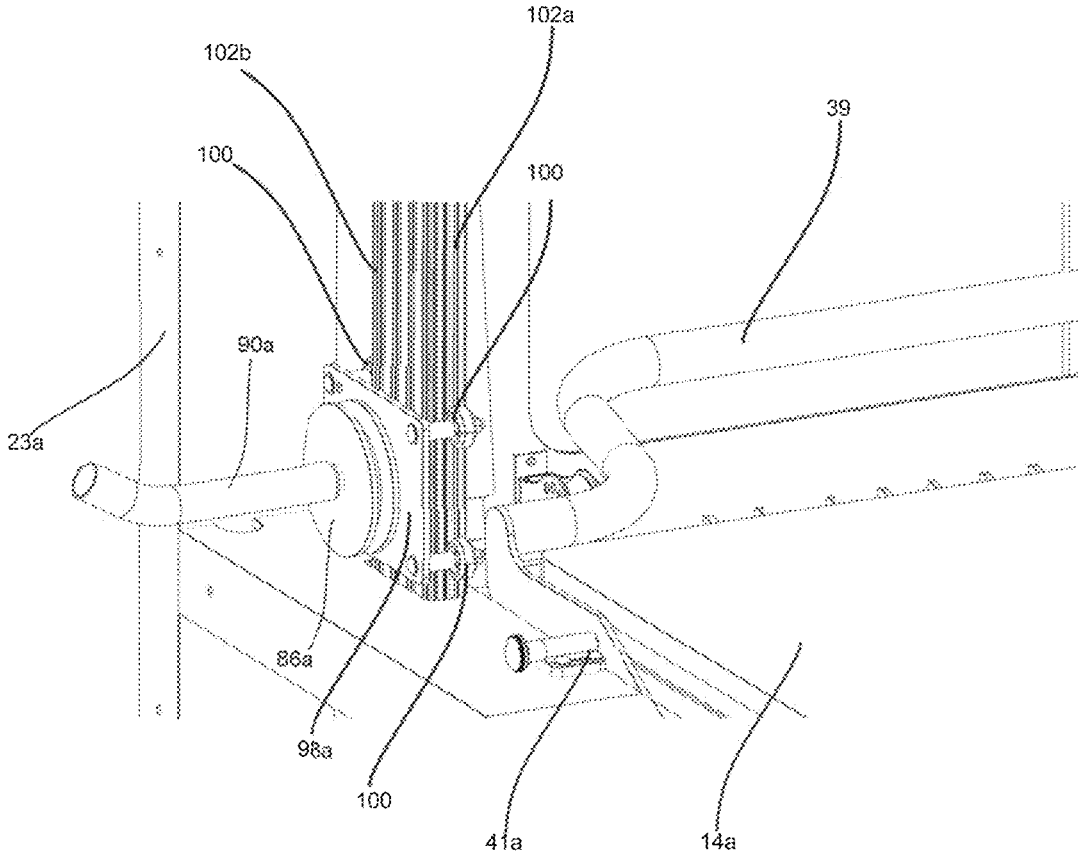
FIG. 13 is a detailed view of a section of the second resistance system of FIG. 12.

The second resistance system 18*a*, 18*b* is illustrated in FIGS. 11 to 13. The second resistance system 18*a*, 18*b* includes a load (not shown) and an actuation member 91*a*. The actuation member 91*a* displaces the load when a force exerted by the user on the actuation member 91*a* exceeds a predetermined threshold representative of the load. The second resistance system 18*a* also includes a support 90*a*, a pulley system 92*a* and a guide 94*a*.

The second resistance system 18*a*, 18*b* is used for constant resistance training. The user performs an exercise which actuates the actuation member 91*a* to displace the load, and the force required to displace the load is constant throughout the movement. Constant resistance training has the benefits of being more functional, meaning the movements used in specific sports are better replicated by constant resistance training. Additionally, constant resistance training has been found to stimulate more muscles at one time, because muscles are used to stabilise the primary working muscle.

The second resistance system 18*a*, 18*b* includes substantially the same components on either side of the frame 12. Therefore, for reasons of conciseness and brevity, only the components on the left side will be described herein. Components on the left hand side of the frame will be marked with the suffix "a", and reference numerals of like components on the right hand side will be marked with the suffix "b".

The load is moveably mounted to the frame 12. In this embodiment, the load is mounted to the second section 12*b*, however in alternative embodiments the load may be mounted at any suitable location on the frame 12, for example on the first section 12*a*. In this embodiment, the load is in the form of a plurality of weighted members, for example weighted plates. The weighted members are selectively applied/removed from the frame 12 to create the required load. For example, if the user wished to perform an exercise using a 10 kg load, they could mount two 5 kg weighted members to the frame 12. The weighted members may be any suitable weight, and the weights of the weighted members may vary. This increases the range of possible loads, and therefore the range of possible resistances available to the user. Each of the weighted members includes a hole (not shown) for facilitating the mounting of the weighted member to the frame 12.

The support 90*a* supports the load on the frame 12, as illustrated clearly in FIG. 13. The support 90*a* is moveable relative to the frame 12. In this embodiment, the support 90*a* includes a bar 90*a* extending from the frame 12. The support 90*a* also includes a base plate 98*a* and at least one wheel assembly 100. The support 90*a* extends perpendicularly from the frame 12*a*. The support 90*a* includes curved end extending in a generally upward direction for restricting the movement of the weighted member, and helping to prevent the weighted member from falling off the support 90*a* and potentially injuring the user. In order to mount the weighted member to the frame 12, the support 90*a* is inserted through the hole in the weighted member.

It shall be appreciated that in alternative embodiments, any suitable mechanism for mounting the load to the support may be used, for example hooks. Alternatively, the support may be provided in the form of a pin. In this embodiment, the weighted members are permanently mounted to the frame in a stacked configuration, In order to adjust the load, the pin is inserted into a hole in the weighted member and only the weighted members located above the pin are displaced.

The base plate 98*a* and the wheel assemblies 100 help to enable the slidable mounting of the load relative to the frame 12. The bar 90*a* extends from the centre of the base plate 98*a*. The base plate 98*a* is substantially rectangular, however any suitable shape of base plate may be used. In this embodiment, there are four wheel assemblies 100 located at four corners of the base plate 98*a*, however any suitable number of wheel assemblies may be used at any suitable location. Each of the wheel assemblies 100 includes a shaft and a wheel. The shafts extend perpendicularly from the base plate 98*a*, and the wheels are free to rotate about a longitudinal axis of the shafts. The wheel assemblies 100 are each mounted to the base plate 98*a* using a threaded fastener.

The guide 94*a* facilitates displacement of the load relative to the frame 12. The guide 94*a* includes a first end 95*a*, a second end 97*a*, and at least one groove 102*a* and extends in the generally vertical direction. The load is slidably connected to the guide 94*a* via the support 90*a*. In this embodiment, an axial length of the guide 94*a* is greater than half of an axial length of the second section 12*b*. However, the length of the guide 94*a* may be varied depending on the range of motion required. The first end 95*a* of the guide 94*a* is mounted to the frame 12 via a bracket 104*a* extending from the frame 12. In alternative embodiments, the guide may be directly fastened to the frame, or may be formed in a recessed section of the frame.

In this embodiment, two grooves 102*a*, 102*b* are provided on opposing elongate surfaces of the guide 94*a*. In order to facilitate movement of the support 90*a* relative to the frame 12, the wheels slidably engage with the grooves 102*a*, 102*b*. The grooves 102*a*, 102*b* extend into the guide 94*a* in the x-direction. The grooves 102*a*, 102*b* are linear and extend in the vertical direction to enable vertical displacement of the load.

The actuation member 91*a* is connected to the load, as illustrated in FIG. 12. In this embodiment, the actuation member 91*a* is a cable connected to the support 90*a* so as to transfer the force generated by the user to the load, and displace the load in the vertical direction. The actuation member 91*a* includes a first attachment feature (not shown) located at first end of the actuation member 91*a*, and a second attachment feature (not shown) located at the second end of the actuation member 91*a*. The attachment features, for examples clips, are suitable for attaching any suitable gym apparatus, for example a handle. The provision of a first and second attachment feature enables the user to perform constant resistance exercises at different location on the exercise apparatus 10.

In this embodiment, the actuation member 91*a* is a continuous member that extends through both the upper and lower pulleys system. The lower pulley system is particularly useful when the user performs an exercise with the first section 12*a* in the vertical position. The lower pulley system of this embodiment includes a support pulley 86*a*, a first pulley 106*a*, a second pulley 107*a*, a third pulley 108*a*, a fourth set of pulleys 109*a* and a stop. The support pulley 86*a* is located on the support 90*a*. The first pulley 106*a* is located towards the first end 95*a* of the guide 94 and the second, third and fourth pulleys 107*a*, 108*a*, 109*a* are located towards the base of the frame 12. In this embodiment, the second, third and fourth set of pulleys 107*a*, 108*a*, 109*a* are located on the first support arm 37*a*.

The actuation member 91*a* extends from the load upwardly in the vertical direction and over the first pulley 106*a*. In this embodiment, the actuation member 91*a* extends from a first side of the support pulley 86*a*. From here, the actuation member 91*a* extends downwardly in the vertical direction towards the second pulley 107*a*, and then in the horizontal direction towards the third pulley 108*a*. Finally, the first end of the actuation member 91*a* extends through the fourth set of pulleys 109*a*.

The upper pulley system is particularly useful when the user performs an exercise when all of the carriages 14*a-d* are assembled. The upper pulley system includes the support pulley 86*a*, a first set of pulleys 110*a*, a second set of pulleys 111*a* and a third pulley 112*a* and a stop. The first set of pulleys 110*a* is located towards the first end 95*a* of the guide 94*a*, and the second set of pulleys 111*a* and third pulley 112*a* are located on the second section 12*b* of the frame 12. The second set of pulleys 111*a* is located below and inward of the first set of pulleys 110*a*, and the third pulley 112*a* is located inward of the second set of pulleys 111*a*.

The actuation member 91*a* extends from the load upwardly in the vertical direction and over the first set of pulleys 110*a*. In this embodiment, the actuation member extends from a second side of the support pulley 86*a*. From here, the actuation member 91*a* extends downwardly in the vertical direction towards the second set of pulleys 111*a*. From the second set of pulleys 111*a*, the actuation member 91*a* extends in the z-direction towards the third pulley 112*a* so that the second end of the actuation member 91*a* extends through the third pulley 112*a*. This means that the user can displace the support 90*a* from both the first and second ends of the actuation member 91*a*.

The upper and lower pulley systems are both provided with a stop in order to prevent the actuation member 91*a* being pulled out of the pulleys of either the upper or lower pulley systems. The stops are of a similar configuration to the stop 55 of the first resistance system 16. The stops is in the form of a bar attached to one of the pulleys and extending in a direction perpendicular to the axis of rotation of the respective pulley. In this embodiment, the stops are located on the pulleys 109*a* and 112*a*. The stops are arranged so as to allow the actuation member 91*a* to pass underneath the stop, but to prevent the attachment feature from passing underneath the stop. As such, when the first end of the actuation member 91*a* is actuated by the user, the second end cannot be pulled out of pulley 112, and when the second end of the actuation member 91*a* is actuated by the user, the first end cannot be pulled out of pulley 109.

It shall be appreciated that the pulley systems described above are one possible embodiment of many possible pulley systems. In alternative embodiments, there may be any number of pulleys in any suitable arrangement. Alternatively, the pulleys may be omitted and an alternative system may be used to transfer the force required to displace the load, for example a gear transmission system.

In addition, a separate actuation member may be provided with each of the upper and lower pulley systems, and/or a second load may be provided. This would enable the user to perform exercises under using a larger and smaller weight in succession without having to adjust the amount of load.

A storage unit (not shown), for example a cupboard or a rack may be provided as part of the exercise apparatus 10. The storage unit may be used to store components of the exercise apparatus 10, including but not limited to the fixed carriages 14*c*, 14*d*, any of the resilient members and/or the weighted members.

Additional covers and guards (not shown) may be provided on the equipment as required to improve its aesthetics and reduce injury risk due to body parts being trapped by moving parts of the apparatus.

The features described above enable the user to perform exercises using a combination of constant and variable resistance concurrently or successively on the same exercise apparatus 10. Therefore, an exercise apparatus is provided which allows for both variable resistance training and constant resistance training in an apparatus that is compact and self-contained, minimising the space required in fitness studios, gyms and the like.

In an alternative embodiment, the second resistance system may be omitted altogether and exercise apparatus may be suitable for variable resistance training.

Although the teachings have been described above with reference to one or more preferred embodiments, it will be appreciated that various changes or modifications may be made without departing from the scope as defined in the appended claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An exercise apparatus for assisting a user with a range of exercises, the exercise apparatus comprising:

a frame comprising a first section extending in a generally horizontal direction and a second section extending in a generally vertical direction from a first end of the frame;

at least one carriage configured to support a user, wherein the carriage is slidably supported on the first section of the frame;

a first resistance system comprising:

a first resilient member removably connected to at least one of the carriage and the frame, wherein the first resilient member is located on the second section;

wherein displacement of the carriage relative to the frame exerts a tensile force on the resilient member; and a second resistance system comprising:

a load moveably mounted with respect to the frame; and an actuation member connected to the load;

wherein the actuation member is configured to displace the load when a force exerted by the user on the actuation member exceeds a predetermined threshold representative of the load.

2. The exercise apparatus of claim 1, wherein the first section is pivotable relative to the second section between the generally horizontal direction and a generally vertical position.

3. The exercise apparatus of claim 1, wherein the first resilient member is located on the second section in a generally vertical orientation.

4. The exercise apparatus of claim 1, wherein the first resilient member is removably connectable to the carriage via a connecting member.

5. The exercise apparatus of claim 4, wherein the carriage includes a first attachment location for connecting to a first attachment device.

6. The exercise apparatus of claim 1, wherein the first resistance system includes a second resilient member, and wherein the second resilient member is removably connected between the carriage and a second end of the frame.

7. The exercise apparatus of claim 6, wherein the second resilient member includes a second attachment device for removably connecting the second resilient member to the carriage.

8. The exercise apparatus of claim 1, wherein the at least one carriage further comprises a second carriage.

9. The exercise apparatus of claim 8, wherein the carriage and the second carriage are slidable relative to each other, wherein the first resistance system includes a third resilient member, and wherein a first end of the third resilient member is removably connected to the carriage, and a second end of the third resilient member is removably connected to the second carriage.

10. The exercise apparatus of claim 9, wherein the third resilient member includes a third attachment device for removably connecting the carriage and second carriages, wherein the carriage or the second carriage includes a third attachment location for connecting to the third attachment device.

11. The exercise apparatus of any claim 9, wherein the first resistance system includes a second resilient member, and wherein the second resilient member is removably connected between the second carriage and a second end of the frame, and wherein at least one of the second resilient member and third resilient member is supported on an underside of the first carriage or the second carriage or both.

12. The exercise apparatus of claim 11, wherein the underside of the carriage includes at least one channel for housing the second resilient member.

13. The exercise apparatus of claim 9, wherein the first resistance system includes a second resilient member, and wherein the second resilient member is removably connected between the second carriage and a second end of the frame, and wherein the first resilient member is a first set of resilient members and wherein each of the first set of resilient members is removably connected to the frame or the carriage, or both.

14. The exercise apparatus of claim 9, wherein the first resistance system includes a second resilient member, and wherein the second resilient member is removably connected between the second carriage and a second end of the frame, and wherein at least one of first, second and third resilient members are springs.

15. The exercise apparatus of claim 1, wherein the second resistance system includes a support connected to the frame, and wherein the support is configured to support the load.

16. The exercise apparatus of claim 1 comprising at least one fixed carriage removably assembled on the frame.

17. The exercise apparatus of claim 1, wherein the frame includes a handle beam located at a first end of the frame.

18. The exercise apparatus of claim 1, wherein the frame includes a leg located at a second end of the frame.

19. The exercise apparatus of claim 1, wherein the second resistance system comprises a plurality of weighted members, and wherein at least one of the weighted members is mounted to the frame to provide the load.

20. The exercise apparatus of claim 1, wherein the force required to displace the load is constant through a movement range of the actuation member by the user.

21. An exercise apparatus for assisting a user with a range of exercises, the exercise apparatus comprising:

a frame comprising a first section extending in a generally horizontal direction;

a first carriage and a second carriage located between a first end of the frame and the first carriage, wherein the first carriage and second carriage are configured to support a user, and wherein the first carriage and second carriage are slidably supported on the first section of the frame;

a first resistance system comprising:

a first resilient member removably connected to at least one of the first carriage, the second carriage and the frame;

wherein displacement of the first carriage or second carriage relative to the frame exerts a tensile force on the resilient member; and a second resistance system comprising:

a load moveably mounted with respect to the frame; and an actuation member connected to the load;

wherein the actuation member is configured to displace the load when a force exerted by the user on the actuation member exceeds a predetermined threshold representative of the load.

22. The exercise apparatus according to claim 21, wherein the first carriage and the second carriage are slidable relative to each other.

23. The exercise apparatus according to claim 22, wherein the first resistance system includes a third resilient member, and wherein a first end of the third resilient member is removably connected to the first carriage, and a second end of the third resilient member is removably connected to the second carriage.

24. An exercise apparatus for assisting a user with a range of exercises, the exercise apparatus comprising:

a frame comprising a first section extending in a generally horizontal direction;

at least one carriage configured to support a user, wherein the carriage is slidably supported on the first section of the frame;

a first resistance system comprising:

a first resilient member removably connected to at least one of the carriage and the frame;

wherein displacement of the carriage relative to the frame exerts a tensile force on the resilient member; and a second resistance system comprising:

a plurality of weighted members, wherein at least one of the plurality of weighted member is moveably mounted to the frame; and an actuation member connected to at least one of the plurality of weighted members;

wherein the actuation member is configured to displace at least one of the plurality of weighted members when a force exerted by the user on the actuation member exceeds a predetermined threshold representative of a load.

25. The exercise apparatus of claim 24, wherein the force required to displace at least one of the plurality of weighted members is constant through a movement range of the actuation member by the user.

* * * * *